US009207603B2

(12) United States Patent
Murakami et al.

(10) Patent No.: US 9,207,603 B2
(45) Date of Patent: Dec. 8, 2015

(54) FIXING DEVICE AND IMAGE FORMING APPARATUS WITH VELOCITY DIFFERENCE SETTING MEANS

(71) Applicant: Konica Minolta, Inc., Tokyo (JP)

(72) Inventors: Masanori Murakami, Aichi (JP); Tsutomu Sakamaki, Tokyo (JP); Takashi Yamada, Tokyo (JP); Toru Komatsu, Tokyo (JP); Naohiko Hanyu, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/039,493

(22) Filed: Sep. 27, 2013

(65) Prior Publication Data

US 2014/0086608 A1 Mar. 27, 2014

(30) Foreign Application Priority Data

Sep. 27, 2012 (JP) ..... 2012-214191
Jun. 19, 2013 (JP) ..... 2013-128922

(51) Int. Cl.
*G03G 15/20* (2006.01)

(52) U.S. Cl.
CPC ..... *G03G 15/2085* (2013.01); *G03G 15/2028* (2013.01); *G03G 15/2046* (2013.01); *G03G 2215/2045* (2013.01)

(58) Field of Classification Search
CPC ..... G03G 15/2085; G03G 15/2028; G03G 15/2046; G03G 2215/2045
USPC ..... 399/67
See application file for complete search history.

(56) References Cited

U.S. PATENT DOCUMENTS

| | | | | |
|---|---|---|---|---|
| 5,359,401 | A | 10/1994 | Uehara et al. | |
| 6,898,387 | B2 * | 5/2005 | Kawamura | 399/67 |
| 8,837,971 | B2 * | 9/2014 | Kemmochi et al. | 399/67 |
| 8,843,010 | B2 * | 9/2014 | Okuno et al. | 399/67 |
| 2011/0222886 | A1 * | 9/2011 | Tsukioka | |
| 2013/0336671 | A1 * | 12/2013 | Tamaki et al. | 399/67 |

FOREIGN PATENT DOCUMENTS

| | | | |
|---|---|---|---|
| JP | 01081981 | A * | 3/1989 |
| JP | 6250560 | A | 9/1994 |
| JP | 07302013 | A * | 11/1995 |
| JP | 09138598 | A | 5/1997 |
| JP | 10221999 | A | 8/1998 |
| JP | 10333378 | A * | 12/1998 |
| JP | 2003215973 | A * | 7/2003 |
| JP | 2004145213 | A * | 5/2004 |
| JP | 2004157283 | A * | 6/2004 |
| JP | 2006256708 | A * | 9/2006 |

* cited by examiner

*Primary Examiner* — Susan Lee
(74) *Attorney, Agent, or Firm* — Cantor Colburn LLP

(57) ABSTRACT

Disclosed herein are a fixing device and an image forming apparatus including: a rotatable fixing side member; a rear side member that rotates in pressure contact with an outer peripheral surface of the fixing side member, the rear side member forming a fixing nip portion for conveying a sheet on which a toner image is formed in a sandwiching manner in conjunction with the fixing side member; and velocity difference setting structure for setting a velocity difference between a surface velocity of the rear side member and a surface velocity of the fixing side member, wherein the rear side member and the fixing side member rotate with a velocity difference set by the velocity difference setting structure.

21 Claims, 15 Drawing Sheets

721

| BASIS WEIGHT OF SHEET [g/m2] | SHEET TYPE | | | | | | | | | | | | | | |
|---|---|---|---|---|---|---|---|---|---|---|---|---|---|---|---|
| | A | | | B | | | C | | | D | | | E | | |
| | BRAKE | | ASSIST | BRAKE | | ASSIST | BRAKE | | ASSIST | BRAKE | | ASSIST | BRAKE | | ASSIST |
| | MOTOR M1 | MOTOR M2 | | MOTOR M1 | MOTOR M2 | | MOTOR M1 | MOTOR M2 | | MOTOR M1 | MOTOR M2 | | MOTOR M1 | MOTOR M2 | |
| 55~61 | OFF | OFF | ON | OFF | OFF | ON | OFF | OFF | ON | OFF | OFF | ON | OFF | OFF | ON |
| 62~74 | OFF | OFF | ON | OFF | OFF | ON | OFF | OFF | ON | OFF | OFF | ON | OFF | OFF | ON |
| 75~80 | OFF | OFF | ON | OFF | OFF | ON | OFF | OFF | ON | OFF | OFF | ON | OFF | OFF | ON |
| 81~91 | OFF | OFF | OFF | OFF | OFF | OFF | OFF | OFF | OFF | OFF | OFF | OFF | OFF | OFF | OFF |
| 92~105 | OFF | OFF | OFF | OFF | OFF | OFF | OFF | OFF | OFF | OFF | OFF | OFF | OFF | OFF | OFF |
| 106~135 | ON | ON | OFF | ON | ON | OFF | ON | ON | OFF | ON | ON | OFF | ON | ON | OFF |
| 136~176 | ON | ON | OFF | ON | ON | OFF | ON | ON | OFF | ON | ON | OFF | ON | ON | OFF |
| 177~216 | ON | ON | OFF | ON | ON | OFF | ON | ON | OFF | ON | ON | OFF | ON | ON | OFF |
| 217~256 | ON | ON | OFF | ON | ON | OFF | ON | ON | OFF | ON | ON | OFF | ON | ON | OFF |
| 257~300 | ON | ON | OFF | ON | ON | OFF | ON | ON | OFF | ON | ON | OFF | ON | ON | OFF |
| 301~350 | ON | ON | OFF | ON | ON | OFF | ON | ON | OFF | ON | ON | OFF | ON | ON | OFF |

FIG. 6

722

| SELECT MODE | SHEET TYPE MODE |
|---|---|
| PLAIN | A |
| COLOR COPY | A |
| COLORED | A |
| HIGH QUALITY | A |
| COATED-GL | B |
| COATED-ML | C |
| COATED-GO | D |
| COATED-MO | E |

FIG. 7

723

| BASIS WEIGHT OF SHEET [g/m2] | SHEET TYPE | | | | | | | | | |
|---|---|---|---|---|---|---|---|---|---|---|
| | A | | B | | C | | D | | E | |
| | MOTOR M1 | MOTOR M2 | MOTOR M1 | MOTOR M2 | MOTOR M1 | MOTOR M2 | MOTOR M1 | MOTOR M2 | MOTOR M1 | MOTOR M2 |
| 55~61 | OFF | OFF | ON | ON | ON | ON | ON | ON | ON | ON |
| 62~74 | OFF | OFF | ON | ON | ON | ON | ON | ON | ON | ON |
| 75~80 | OFF | OFF | ON | ON | ON | ON | ON | ON | ON | ON |
| 81~91 | OFF | OFF | ON | ON | ON | ON | ON | ON | ON | ON |
| 92~105 | OFF | OFF | ON | ON | ON | ON | ON | ON | ON | ON |
| 106~135 | ON | ON | ON | ON | ON | ON | ON | ON | ON | ON |
| 136~176 | ON | ON | ON | ON | ON | ON | ON | ON | ON | ON |
| 177~216 | ON | ON | ON | ON | ON | ON | ON | ON | ON | ON |
| 217~256 | ON | ON | ON | ON | ON | ON | ON | ON | ON | ON |
| 257~300 | ON | ON | ON | ON | ON | ON | ON | ON | ON | ON |
| 301~350 | ON | ON | ON | ON | ON | ON | ON | ON | ON | ON |

FIG. 8

724

| | PLAIN SHEET | SHEET TYPE B | SHEET TYPE C | SHEET TYPE D | SHEET TYPE E |
|---|---|---|---|---|---|
| 150~170°C | LOW | HIGH | HIGH | HIGH | HIGH |
| 171~190°C | NON | INTERMEDIATE | INTERMEDIATE | INTERMEDIATE | INTERMEDIATE |
| 191~200°C | NON | LOW | LOW | LOW | LOW |

FIG. 9

725

| | TONER COVERAGE RATE | | | |
|---|---|---|---|---|
| TONER ADHESION AMOUNT | ~25% | 26~50% | 51~75% | 76~100% |
| 0~5g/m² | HIGH | HIGH | HIGH | INTERMEDIATE |
| 5.1~8g/m² | HIGH | HIGH | INTERMEDIATE | LOW |
| 8.1~11g/m² | HIGH | INTERMEDIATE | LOW | LOW |

FIG. 10

FIXING DEVICE AND IMAGE FORMING APPARATUS WITH VELOCITY DIFFERENCE SETTING MEANS

CROSS REFERENCE TO RELATED APPLICATIONS

This application is entitled and claims the benefit of Japanese Patent Application No. 2012-214191, filed on Sep. 27, 2012, and No. 2013-128922, filed on Jun. 19, 2013, the disclosures of which including the specification, drawings and abstract are incorporated herein by reference in their entirety.

BACKGROUND OF THE INVENTION

1. Field of the Invention

The present invention relates to a fixing device for use in an image forming apparatus of an electrophotographic system, an electrostatic recording system and the like, and an image forming apparatus including the fixing device.

2. Description of Related Art

Generally, an image forming apparatus of the electrophotographic system (such as a printer, copier, and facsimile machine) has a fixing device that applies heat and pressure to a sheet on which a toner image has been transferred to fix the toner. Such a fixing device includes a heating section that heats toner borne on a sheet to melt the toner, and a pressing section that presses the sheet against the heating section.

The pressing section of the fixing device includes, for example, a fixing roller and a pressure roller that is pressed against the fixing roller with a predetermined load. The pressure roller is pressed directly or indirectly against the fixing roller, thus forming a nip portion for conveying a sheet in a sandwiching manner.

The heating section of the fixing device is composed of, for example, an endless fixing belt provided around a heating roller having a heating source (for example halogen heater) therein and the fixing roller in a stretched state (heat belt type). In this case, the pressure roller is pressed against the fixing roller with the fixing belt therebetween, thus forming the nip portion. In addition, the fixing roller may have the heating source therein and the fixing roller itself may serve as the heating section (heat roller type). In this case, the pressure roller is pressed directly against the fixing roller, thus forming the nip portion.

In an image forming apparatus having the above-described fixing device, a toner image is developed on a photoconductor drum based on image data, and the toner image thus developed is transferred onto a sheet. Then, the sheet on which the toner image has been transferred is conveyed to the fixing device, and heat and pressure is applied to the sheet at the time when the sheet passes through the nip portion, whereby the toner image is fixed to the sheet.

Such a fixing device is known as disclosed in Japanese Patent Application Laid-Open Nos. 6-250560, 10-221999, and 9-138598, for example.

In the fixing device of Japanese Patent Application Laid-Open Nos. 6-250560 and 10-221999, part of an endless belt provided around a plurality of rollers in a stretched state is wound around a fixing roller so as to form a nip portion. A pressure roller, which makes pressure contact with the fixing roller from the internal circumference side of the endless belt with the endless belt therebetween, is provided at an exit portion of the nip portion. In the fixing device, a braking force is exerted on the endless belt during conveyance in a region of the pressure roller making pressure contact with the fixing roller so as to equal the difference in velocity between the pressure roller and the fixing roller, thereby preventing image deviation. Meanwhile, in the fixing device of Japanese Patent Application Laid-Open No. 9-138598, a heat-resistant belt is supported by a plurality of rollers around which it is wound, and a pressure roller is pressure contact with the rollers with the heat-resistant belt therebetween. In addition, the rollers are braked to impart a tensile force to the heat-resistant belt.

Incidentally, in the fixing device, a surface of a sheet on which an unfixed toner image is borne directly contacts with the heating section at a fixing step (fixing belt or fixing roller). At this time, occasionally, wax exuded from toner adheres to the heating section (fixing belt or fixing roller), and a latent image is formed by the wax adhered to the heating section and visualized in the next image. To be more specific, the wax adhered to the heating section is visualized by a phenomenon (referred to as gloss memory) in which the wax adhered to the heating section is visualized in the form of gloss unevenness caused by a portion having a small amount of the adhered wax and a portion having a large amount of the adhered wax when toner for forming the next image is fixed.

There has been a desire to eliminate the gloss memory at the time of fixing toner in the fixing device to improve image quality. It is to be noted that the problem of prevention of the gloss memory cannot be solved by the fixing devices disclosed in Japanese Patent Application Laid-Open Nos. 6-250560, 10-221999, and 9-138598.

SUMMARY OF THE INVENTION

In order to solve the above-mentioned problems, an object of the present invention is to provide a fixing device which prevents gloss memory caused by the record of the preceding fixing step in fixing toner to a sheet, and thus ensures a high image quality, and an image forming apparatus including the fixing device.

To achieve the above-mentioned object, a fixing device reflecting one aspect of the present invention includes:

a rotatable fixing side member; and a rear side member that rotates in pressure contact with an outer peripheral surface of the fixing side member, the rear side member forming a fixing nip portion for conveying a sheet on which a toner image is formed in a sandwiching manner in conjunction with the fixing side member, wherein velocity difference setting means for setting a velocity difference between a surface velocity of the rear side member and a surface velocity of the fixing side member is provided, and the rear side member and the fixing side member rotate with a velocity difference set by the velocity difference setting means.

Desirably, in the above-mentioned fixing device, the velocity difference setting means sets the velocity difference such that the surface velocity of the fixing side member is lower than the surface velocity of the rear side member.

Desirably, in the above-mentioned fixing device, the velocity difference setting means sets the velocity difference such that the surface velocity of the fixing side member is lower than the surface velocity of the rear side member by 0.3 to 0.8%.

Desirably, the above-mentioned fixing device further includes a driving section that drives the rear side member into rotation in a conveyance direction, wherein the velocity difference setting means sets the velocity difference by imparting a braking torque for braking the rotation of the rear side member in the conveyance direction to the fixing side member.

Desirably, in the above-mentioned fixing device, the braking torque includes a plurality of changeable torques differing in magnitude, and the velocity difference setting means selects a braking torque from the changeable torques and imparts the braking torque thus selected to the fixing side member.

Desirably, in the above-mentioned fixing device, the velocity difference setting means is capable of imparting to the fixing side member an auxiliary driving torque for rotating the fixing side member along with the rotation of the rear side member in addition to the braking torque, and the braking torque and the auxiliary driving torque are changeable.

Desirably, in the above-mentioned fixing device, the velocity difference setting means includes a motor switchable between a generation of the braking torque, a generation of the auxiliary driving torque that is a fixed torque, and a stoppage.

Desirably, in the above-mentioned fixing device, the velocity difference setting means includes a plurality of the motors, and the motors operate separately or together to impart the braking torque to the fixing side member.

Desirably, in the above-mentioned fixing device, the motors differ in at least one of an activation timing and a stop timing.

Desirably, in the above-mentioned fixing device, the braking torque is changed in accordance with a sheet type.

Desirably, in the above-mentioned fixing device, the braking torque is changed in accordance with a temperature of the fixing side member.

Desirably, in the above-mentioned fixing device, the braking torque is changed in accordance with an amount of a toner adhered on the sheet.

Desirably, in the above-mentioned fixing device, the velocity difference setting means includes an electromagnetic brake section that is changeable by an input current or an input voltage, the electromagnetic brake section imparting the braking force to the fixing side member.

Desirably, in the above-mentioned fixing device, the velocity difference setting means includes a fixing side driving section and a rear side driving section which respectively drive the fixing side member and the rear side member into rotation in a separate manner, the velocity difference setting means setting the velocity difference by driving the fixing side driving section and the rear side driving section.

Desirably, the above-mentioned fixing device further includes data computing means for computing data related to a toner adhesion amount at each position in the sheet conveyance direction on the sheet, wherein the velocity difference setting means imparts braking torques corresponding to data at respective positions computed by the data computing means to the fixing side member when the positions in the sheet conveyance direction on the sheet passes through the fixing nip portion.

Desirably, in the above-mentioned fixing device, the data computing means computes the data at each position in the sheet conveyance direction on the sheet on the basis of image data corresponding to the toner image on the sheet.

Desirably, in the above-mentioned fixing device, the data computing means computes the data at each position in the sheet conveyance direction on the sheet on the basis of a toner image formed on a photoconductor.

Desirably, in the above-mentioned fixing device, the data computing means computes the data at each position in the sheet conveyance direction on the sheet on the basis of a toner image formed on an intermediate transfer member.

Desirably, in the above-mentioned fixing device, the data computing means computes an integrated value of the toner adhesion amount at each position in a sheet width direction perpendicular to the sheet conveyance direction as the data for each position in the sheet conveyance direction on the sheet.

Desirably, in the above-mentioned fixing device, the data computing means computes an average value of the toner adhesion amount at each position in a sheet width direction perpendicular to the sheet conveyance direction as the data for each position in the sheet conveyance direction on the sheet.

Desirably, in the above-mentioned fixing device, the data computing means computes a ratio of a position where the toner adhesion amount is greater than a predetermined adhesion amount with respect to positions in a sheet width direction perpendicular to the sheet conveyance direction for each position in the sheet conveyance direction on the sheet.

Desirably, in the above-mentioned fixing device, fixing is performed on a first surface of the sheet and then on a second surface of the sheet in the fixing nip portion, the data computing means computes data related to a toner adhesion amount at each position in the sheet conveyance direction on the first and second surfaces of the sheet, and the velocity difference setting means imparts braking torques corresponding to data at respective positions on the first and second surfaces of the sheet computed by the data computing means to the fixing side member when the positions in the sheet conveyance direction on the second surface of the sheet pass through the fixing nip portion.

An image forming apparatus reflecting another aspect of the present invention includes the fixing device having the above-mentioned configuration.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 6 illustrates a motor driving table used in the control of the fixing section illustrated in FIG. 5;

FIG. 7 illustrates a sheet type table used in the control of the fixing section illustrated in FIG. 5;

FIG. 8 illustrates a modification of the motor driving table according to the present embodiment;

FIG. 9 illustrates a motor driving table used in a fixing process of an image forming apparatus according to embodiment 2 of the present invention;

FIG. 10 illustrates a motor driving table used in a fixing process of an image forming apparatus according to embodiment 3 of the present invention;

DESCRIPTION OF THE PREFERRED EMBODIMENTS

In the following, embodiments of the present invention are described in detail with reference to the drawings.

Figure 1:
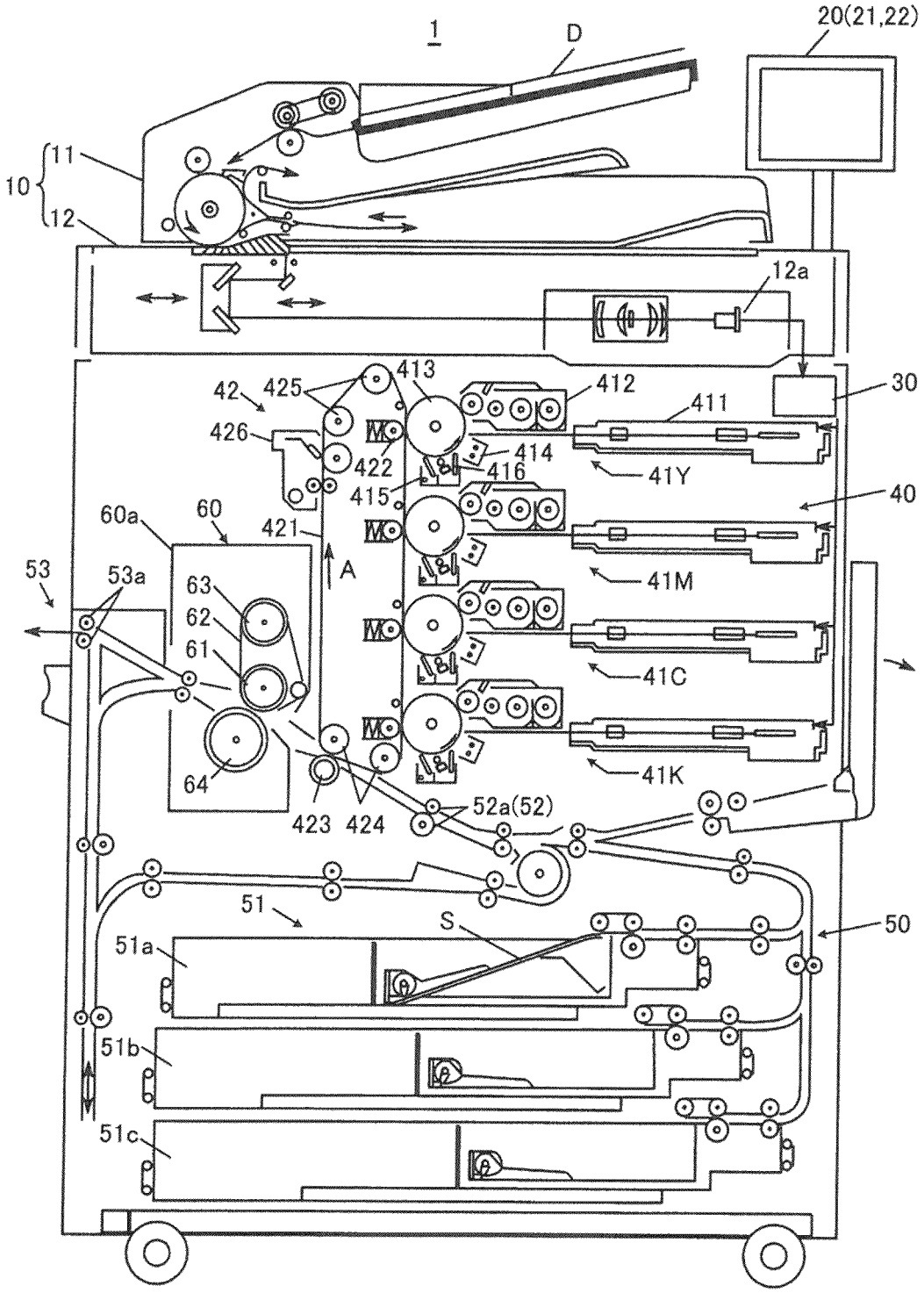
FIG. 1 schematically illustrates a general configuration of an image forming apparatus according to an embodiment of the present invention.
Figure 2:
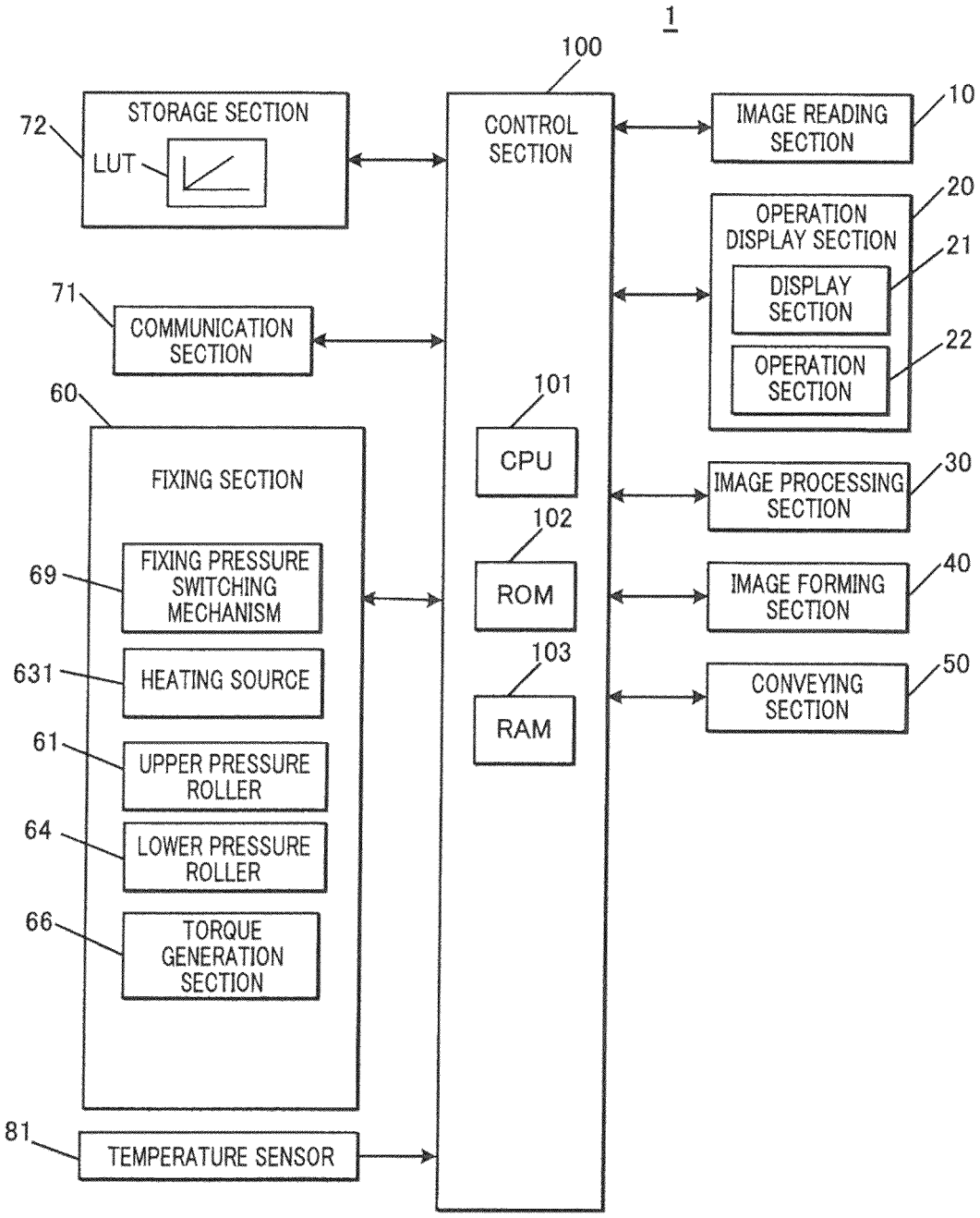
FIG. 2 illustrates a main section of a control system of the image forming apparatus according to the embodiment of the present invention.

FIG. 1 schematically illustrates a general configuration of image forming apparatus 1 according to an embodiment of the present invention, and FIG. 2 illustrates a main section of a control system of image forming apparatus 1 according to the embodiment.

Image forming apparatus 1 illustrated in FIGS. 1 and 2 is an intermediate-transfer type color image forming apparatus utilizing the electrophotographic process. Specifically, image forming apparatus 1 transfers color toner images of C (cyan), M (magenta), Y (yellow), and K (black) formed on a photoconductor onto an intermediate transfer member (primary-transfer), and superposes the toner images of the four colors on the intermediate transfer member. Then image forming apparatus 1 transfers the images onto a sheet (secondary transfer), thereby forming an image.

In addition, image forming apparatus 1 is of a tandem type in which photoconductors corresponding to the four colors of C, M, Y, and K are disposed in series along a travelling direction of an intermediate transfer member, and toner images of respective colors are sequentially transferred onto the intermediate transfer member in a single procedure.

As illustrated in FIGS. 1 and 2, image forming apparatus 1 includes image reading section 10, operation display section 20, image processing section 30, image forming section 40, conveying section 50, fixing section 60, and control section 100.

Control section 100 includes central processing unit (CPU) 101, read only memory (ROM) 102, random access memory (RAM) 103, and the like. CPU 101 reads out a program corresponding to processing details from ROM 102, loads the program in RAM 103, and performs a centralized control of operations of the blocks of image forming apparatus 1 in conjunction with the loaded program. At this time, various kinds of data stored in storage section 72 are referenced. Specifically, storage section 72 stores various kinds of data and a velocity difference setting table for use in a fixing process in fixing section 60. Storage section 72 is composed of a nonvolatile-semiconductor memory (so-called flash memory) or a hard disk drive, for example.

In addition, control section 100 exchanges various kinds of data, via communication section 71, with an external apparatus (for example, a personal computer) connected through a communication network such as local area network (LAN) and wide area network (WAN). For example, control section 100 receives image data (input image data) sent from an external device, and forms an image on a recording sheet based on the received image data. Communication section 71 is composed of a communication control card such as a LAN card, for example.

Image reading section 10 includes an automatic document feeder 11 called auto document feeder (ADF), document image scanning device 12, and the like.

Automatic document feeder 11 conveys document D placed on a document tray by a conveying mechanism and outputs document D to document image scanning device 12. When multiple documents D are placed on the document tray, automatic document feeder 11 can successively read images (including images on both sides) of the documents D at one time.

Document image scanning device 12 optically scans document D conveyed onto a contact glass from automatic document feeder 11 or document D placed on the contact glass, brings light reflected from document D into an image on a light reception surface of charge coupled device (CCD) sensor 12*a*, and reads the image of document D. Image reading section 10 creates data of the input image based on results of the reading of document image scanning device 12. The data of the input image is subjected to a predetermined image process at image processing section 30.

Operation display section 20 is a liquid crystal display (LCD) provided with a touch panel for example, and functions as display section 21 and operation section 22. Display section 21 displays various kinds of operation screens, states of images, operating conditions of various functions, and the like according to a display control signal input from control section 100. Operation section 22 includes various kinds of operation keys such as numeric keys and a start key, receives various kinds of inputting operation by a user, and outputs an operation signal to control section 100.

Image processing section 30 includes a circuit that performs, on the input image data, a digital image process according to an initial setting or user setting, and the like. For example, under the control of control section 100, image processing section 30 performs on the input image data various kinds of corrections such as the gray-scale correction, a color correction and a shading correction, a compression process, and the like. Image forming section 40 is controlled based on the image data having been subjected to the aforementioned processes.

Image forming section 40 includes intermediate transfer unit 42, image forming units 41Y, 41M, 41C, and 41K that form images of colored toners of Y component, M component, C component, and K component on the basis of the input image data, and the like.

Image forming units 41Y, 41M, 41C, and 41K for Y component, M component, C component, and K component have the same configuration, except for the color of the toner. For convenience in illustration of the drawings and description, common components are denoted by the same reference numerals, and in the case where descriptions are separately given, Y, M, C or K is attached to the reference numeral. In FIG. 1, reference numerals are given only for elements of image forming unit 41Y for Y component, and reference numerals for elements of image forming units 41M, 41C, and 41K are omitted.

Image forming unit 41 includes light exposure device 411, developing device 412, photoconductor drum 413, charging apparatus 414, drum cleaning apparatus 415, lubricant coater 416, and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example.

Charging apparatus 414 uniformly and negatively charges the surface of photoconductive photoconductor drum 413. Light exposure device 411 is composed of a semiconductor laser and applies laser light corresponding to images of respective color components to photoconductor drum 413, for example. When positive electric charge is generated in a charge generation layer of photoconductor drum 413 and transported to the surface of the charge transport layer, the electric charge on the surface of photoconductor drum 413 (negative charge) is neutralized. Electrostatic latent images for the respective color components are formed on the surface of photoconductor drum 413 due to a potential difference from the surrounding area.

Developing device 412 contains therein developers of the color components (for example, two-component developers each composed of a toner having a small particle size and a magnetic carrier), and causes toner of each color component to adhere onto the surface of photoconductor drum 413 so as to visualize an electrostatic latent image, thereby forming a toner image.

It is to be noted that, in this example, the toner contained in developing device 412 is a wax-containing toner (oil-free toner) in which wax is dispersed in toner particles. The melting point of the wax contained in the toner is typically low, about 110° C. or below. Examples of the wax usable herein include conventional waxes such as a paraffin wax, a polyolefin wax, and their modified products (for example, their oxides and graft-modified products), a higher fatty acid, and a metal salt of a higher fatty acid, an amide wax, and an ester wax. In addition, as a more preferable wax, a higher fatty acid ester wax may be employed for example.

Drum cleaning apparatus 415 has a drum cleaning blade (hereinafter referred to as DCL blade) which is brought into sliding contact with the surface of photoconductor drum 413. The DCL blade scrapes and removes transfer-residual toner remaining on the surface of photoconductor drum 413 after the primary transfer.

Lubricant coater 416 has a roller-shaped lubricant application brush that makes sliding contact with the surface of photoconductor drum 413. Along with the rotation of photoconductor drum 413, lubricant adhered to the lubricant application brush is applied to the surface of photoconductor drum 413.

Intermediate transfer unit 42 includes intermediate transfer belt 421 serving as an intermediate transfer member, primary transfer roller 422, secondary transfer roller 423, drive roller 424, driven roller 425, belt cleaning device 426, and the like.

Intermediate transfer belt 421 is composed of an endless belt, and is provided around drive roller 424 and driven roller 425 in a stretched state. Intermediate transfer belt 421 moves in an arrow A direction at a constant velocity along with the rotation of drive roller 424. When intermediate transfer belt 421 is brought into pressure contact with photoconductor drum 413 by primary transfer roller 422, color toner images are superposed in sequence and thereby primary-transferred onto intermediate transfer belt 421. Then, intermediate transfer belt 421 is brought into pressure contact with sheet S by secondary transfer roller 423, whereby the toner images primary-transferred on intermediate transfer belt 421 are secondary-transferred on sheet S.

Belt cleaning device 426 includes a belt cleaning blade (hereinafter referred to as BCL blade) that makes sliding contact with the surface of intermediate transfer belt 421. Residual toner remaining on the surface of intermediate transfer belt 421 after the secondary transfer is scraped and removed by the belt cleaning blade.

Thus, an unfixed toner image is formed on sheet S.

The unfixed toner image is fixed to sheet S by fixing section 60. Fixing section 60 applies heat and pressure to sheet S conveyed thereto to fix the unfixed toner image to sheet S. Fixing section 60 mainly includes upper pressure roller 61 serving as a fixing roller housed in frame 60*a*, and lower pressure roller 64 serving as a pressure roller. Fixing section 60 is of a belt nip type in the present embodiment, and the detailed configuration thereof will be described later.

Conveying section 50 includes sheet feeding section 51, conveying mechanism 52, sheet ejecting section 53, and the like. Recording sheets (standard type sheets and special type sheets) S each discriminated based on the basis weight, size, and the like thereof are stored, according to predetermined types, in respective sheet tray units 51*a* to 51*c* configuring sheet feeding section 51.

The recording sheets S stored in sheet tray units 51*a* to 51*c* are output one by one from the uppermost, and conveyed to image forming section 40 by conveying mechanism 52 including a plurality of conveying rollers such as registration rollers 52*a*. At this time, a registration section in which registration rollers 52*a* are arranged corrects the obliqueness of the fed sheet S and adjusts the conveyance timing.

Then, in image forming section 40, the toner image on intermediate transfer belt 421 is collectively secondary-transferred onto one side of sheet S, and a fixing step is performed in fixing section 60. Sheet S on which an image has been formed is ejected from the apparatus by sheet ejecting section 53 having sheet ejecting roller 53*a*.

Image forming apparatus 1 includes photoconductive photoconductor drum 413, charging apparatus 414 that uniformly charges the surface of photoconductor drum 413, light exposure device 411 that emits light to form an electrostatic latent image on the surface of photoconductor drum 413, developing device 412 that causes toner to adhere to the surface of photoconductor drum 413 so as to visualize an electrostatic latent image and thus to form a toner image, and intermediate transfer unit 42 that transfers the toner image to a transfer medium such as intermediate transfer belt 421 and sheet S.

Figure 3:
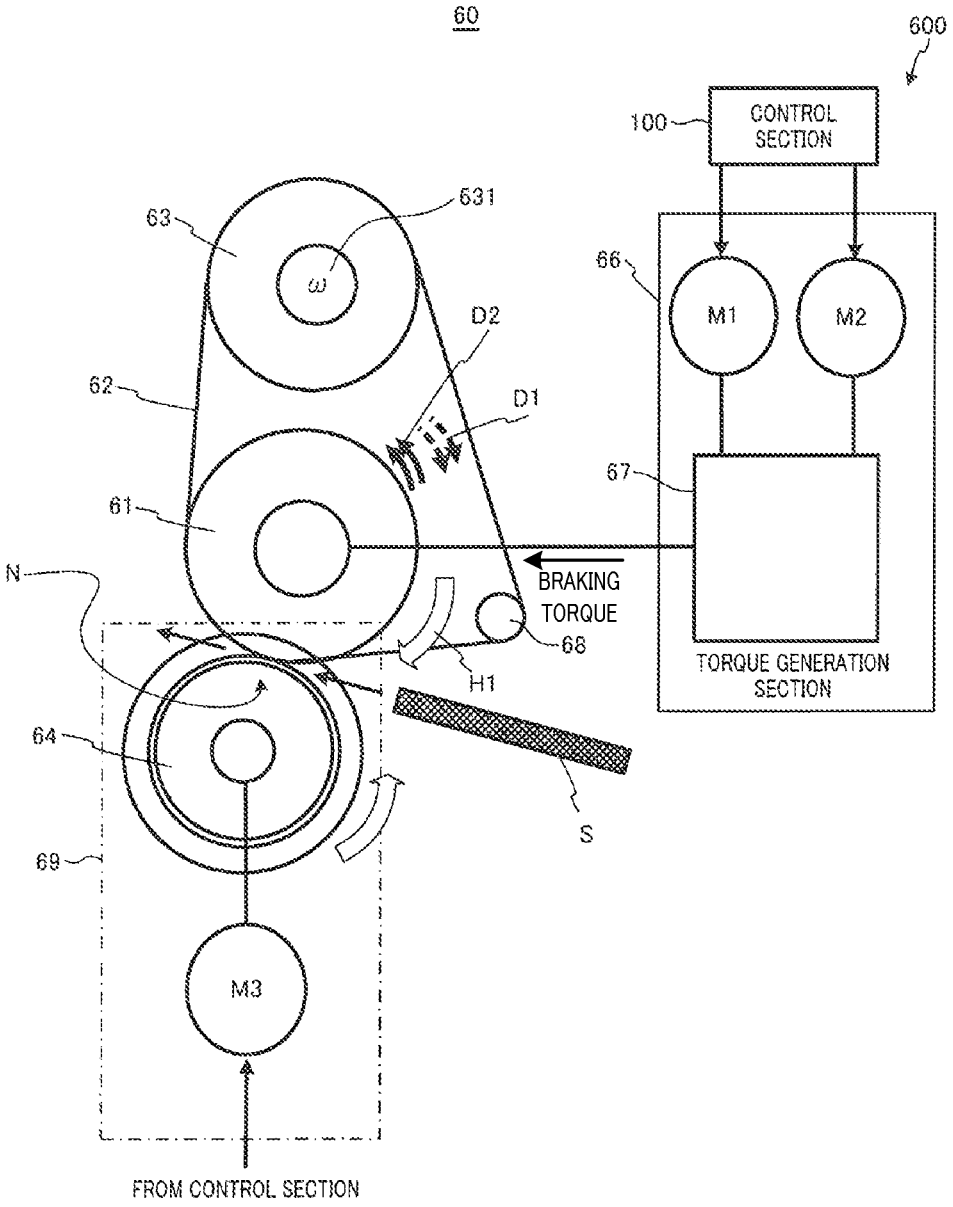
FIG. 3 schematically illustrates a configuration of a fixing section of the image forming apparatus according to the embodiment of the present invention.

The configuration of fixing section 60 according to the present embodiment will be described in detail below with reference to FIG. 3. FIG. 3 schematically illustrates the configuration of fixing section 60.

Fixing section 60 is, for example, a heating-belt type fixing device including a pressing section that forms a nip portion for conveying sheet S in a sandwiching manner, a heating section that makes contact with sheet S on which a toner image has been transferred to heat sheet S at a fixing temperature, and the like.

The pressing section of the heating-belt type fixing section 60 includes an upper pressing section and a lower pressing section. In the upper pressing section, endless fixing belt 62 is provided in a stretched state around heating roller 63, upper pressure roller 61, and stretching member 68. The lower pressing section is composed of lower pressure roller 64. In addition, fixing belt 62 serves as the heating section. In addition, fixing section 60 has fixing nip portion (hereinafter referred to as "nip portion") N for conveying sheet S in a sandwiching manner in a state where lower pressure roller 64 is pressed against upper pressure roller 61 with fixing belt 62 therebetween. Specifically, nip portion N is formed by rotatably provided fixing belt 62 and lower pressure roller 64 that rotates in pressure contact with the surface (outer peripheral surface) of fixing belt 62, and nip portion N conveys sheet S on which a toner image has been formed in a sandwiching manner in conjunction with upper pressure roller 61. Fixing section 60, together with velocity difference setting means 600 including control section 100 and torque generation section 66, composes the fixing device.

Fixing belt 62 is the heating section that makes contact with sheet S on which a toner image has been transferred to heat sheet S at a predetermined temperature. Here, the predetermined temperature is a temperature at which a quantity of heat required for melting the toner on sheet S can be obtained at the time when sheet S passes through nip portion N, and differs depending on factors such as the type of sheet S on which an image is to be formed.

In the proximity of fixing belt 62, temperature sensor 81 (see FIG. 2) for use in a control operation for detecting the temperature of fixing belt 62 is disposed. A signal detected by the temperature sensor 81 for the control operation is output to control section 100 (see FIG. 2). It is to be noted that control section 100 controls the output of heating roller 63 (heating source 631 of heating roller 63) so that a temperature measured by a temperature sensor (not illustrated) is at a previously set temperature (for example, on/off control).

It is to be noted that, for example, fixing belt 62 has a configuration in which an elastic layer made of a silicone rubber or the like, and a surface releasing layer made of a fluorine resin are sequentially stacked on the outer peripheral surface of a film base material made of a heat-resistant polyimide. Examples of the fluorine resin include materials containing any of perfluoro alkoxyalkane (PFA), polytetrafluoroethylene (PTFE), and fluorinated ethylene propylene (FEP), most preferably, any of PFA, PTFE, and FEP. With this configuration, the releasability of the surface of fixing belt 62 in relation to the wax contained in the toner resin and the toner particle is improved, and toner becomes less likely to stick to the surface of fixing belt 62 during the fixing operation.

In addition, fixing belt 62, together with upper pressure roller 61, composes a fixing side member, and forms nip portion N together with lower pressure roller 64 serving as a rear side member.

Stretching member 68 is a roller whose both end portions are rotatably supported, and has an inverted crown shape in which the outer diameter of the end portions is greater than that of a center portion. Stretching member 68 is disposed at a predetermined position spaced apart from the position of nip portion N at which fixing belt 62 is interposed between upper pressure roller 61 and lower pressure roller 64. The predetermined position is a position which is obtained by inclining a line perpendicular to a straight line connecting end points of nip portion N at a predetermined angle toward the upstream side of nip portion N. Stretching member 68 is movably provided at the predetermined position, and the tensile force of fixing belt 62 is adjusted by moving stretching member 68. In addition, it is also possible to adopt a configuration in which stretching member 68 is fixed and heating roller 63 is movably provided, in order to adjust the tensile force of fixing belt 62.

Heating roller 63 heats fixing belt 62 so that sheet S sandwiched at nip portion N is heated by fixing belt 62 at the predetermined temperature. Heating roller 63 has a structure in which a resin layer made of a PTFE resin or the like is formed on the outer peripheral surface of a cylindrical mandrel made of aluminum or the like, for example.

Heating roller 63 has therein heating source 631 composed of, for example, a halogen heater. The output of heating source 631 is controlled by control section 100 so as to heat a mandrel and the resin layer, and as a result, fixing belt 62 is heated. It is to be noted that fixing belt 62 may be heated by electromagnetic induction heating (IH). In that case, a base member of the fixing belt is composed of a material such as Ni which can be caused to generate heat by IH.

Upper pressure roller 61 has a structure in which an elastic layer made of silicone rubber or the like is formed on the outer peripheral surface of a cylindrical mandrel made of iron or the like, for example. Further, a surface releasing layer made of a fluorine resin may be formed on the outer peripheral surface of the elastic layer.

Upper pressure roller 61 (for example, on/off of rotation, rotational velocity, braking force, generation of auxiliary driving force, and the like) is driven and controlled by control section 100 via torque generation section 66.

When upper pressure roller 61 is brought into pressure contact with lower pressure roller 64 driven by a main driving source (motor M3) of fixing section 60 with fixing belt 62 interposed therebetween, upper pressure roller 61 can be rotated along with fixing belt 62. In addition, torques for forward and backward rotations (arrows D1 and D2) in relation to the rotation of lower pressure roller 64 for sheet conveyance are imparted to upper pressure roller 61 from torque generation section 66, whereby upper pressure roller 61 exerts a braking force and an auxiliary driving force on the lower pressure roller 64 driven in the conveyance direction.

Together with upper pressure roller 61, lower pressure roller 64 composes a pressing section for forming nip portion N. Lower pressure roller 64 is pressed against upper pressure roller 61 with fixing belt 62 therebetween by fixing pressure switching mechanism 69.

Lower pressure roller 64 is driven into rotation by motor M3, and this driving control (such as on/off of rotation, rotational velocity, pressure contact with upper pressure roller 61, and separation from upper pressure roller 61), is performed by control section 100. Other configurations of lower pressure roller 64 are the same as those of upper pressure roller 61, and the description thereof is skipped. It is to be noted that lower pressure roller 64 may have therein a heating source such as a halogen heater.

Fixing pressure switching mechanism 69 has biasing means for biasing lower pressure roller 64 toward upper pressure roller 61. The configuration of the biasing means is not particularly limited, and publicly known technology may be applied. Fixing pressure switching mechanism 69 can switch the load for pressing lower pressure roller 64 against upper pressure roller 61 in multiple stages according to the sheet type, basis weight, size, and the like of sheet S used for forming an image. Fixing pressure switching mechanism 69 is driven and controlled by control section 100.

In addition, fixing pressure switching mechanism 69 changes the position of lower pressure roller 64. Thus, when the outer diameter of upper pressure roller 61 is increased due to the thermal expansion caused by the increase in surface temperature of fixing belt 62, the position of lower pressure roller 64 and that of stretching member 68 are accordingly changed. Thus, nip portion N can be moved to an appropriate position.

Torque generation section 66 includes gear mechanism section 67 and motors M1 and M2 that rotate upper pressure roller 61.

Torque generation section 66 separately switches over motors M1 and M2 to switch over the work of upper pressure roller 61 between braking, non-braking, and rotation at a fixed torque. Torque generation section 66 is controlled by control section 100.

Torque generation section 66 herein controls motors M1 and M2 by a pulse width modulation (PWM) control.

Each of motors M1 and M2 separately imparts a predetermined torque to upper pressure roller 61 via gear mechanism section 67 to cause upper pressure roller 61 to generate a braking force and an auxiliary driving force. To be more specific, in order to cause upper pressure roller 61 that rotates following the rotation of lower pressure roller 64 to generate braking force D2 against the rotation in conveyance direction H1 (referred to as forward rotation), motors M1 and M2 impart a torque for a rotation in a direction opposite the forward rotation to upper pressure roller 61. In addition, motors M1 and M2 impart an auxiliary torque to upper pressure roller 61 that rotates following the rotation of lower pressure roller 64 to generate auxiliary driving force D1 for rotating upper pressure roller 61 in direction D1 which is the same direction as the conveyance direction.

Motors M1 and M2 cause upper pressure roller 61 to generate the braking force, thereby preventing a gloss memory described later. In addition, motors M1 and M2 cause upper pressure roller 61 to generate the auxiliary driving force so that fixing belt 62 can be smoothly driven in the case where a thin sheet (60 to 80 g/m2) is conveyed, thus preventing wrinkling of the sheet.

Control section 100 controls the braking force generated at upper pressure roller 61 by the torque of motors M1 and M2, the timing at which the braking force is generated, the timing at which the generated braking force is stopped, and the like. Motors M1 and M2 are driven and controlled by control section 100 using a velocity difference setting table (such as a motor driving table).

Gear mechanism section 67 includes a plurality of gear groups for transmitting the rotation of each of motors M1 and M2 separately to upper pressure roller 61. Specifically, via the gear groups, only one of the torques of motors M1 and M2, or the combination of the torques of motors M1 and M2 is transmitted to upper pressure roller 61. Thus, together with motors M1 and M2, gear mechanism section 67 sets a velocity difference between the rotational velocity of upper pressure roller 61 to which the torque is imparted by driving motors M1 and M2, and the rotational velocity of lower pressure roller 64 so that the rollers rotate with the velocity difference.

Fixing section 60 of the present embodiment performs a fixing process which is executed by control section 100.

Control section 100 receives a condition of image formation (for example, the type, basis weight, size, and the like of a sheet used for the image formation), and information from the sensors such as information about the surface temperature of fixing belt 62 inputted from temperature sensor 81. On the basis of these pieces of received information and information representing the state of toner on the sheet, control section 100 controls fixing section 60. It is to be noted that the information representing the state of toner on the sheet includes the adhesion amount of toner and the toner coverage amount representing the ratio of toner covering the sheet. The information representing the state of toner on the sheet is computed by control section 100 using image data.

Control section 100 drives fixing pressure switching mechanism 69 to bring lower pressure roller 64 into pressure contact with upper pressure roller 61. Control section 100 drives lower pressure roller 64 into rotation via motor M3, and controls heating source 631 so as to heat fixing belt 62 by heating roller 63. In addition, control section 100 drives upper pressure roller 61 via torque generation section 66. With such driving, control section 100 controls fixing section 60 to perform a process (fixing process) in which sheet S is caused to pass through nip portion N and toner is fixed.

In the present embodiment, the fixing process causes a velocity difference between the surface velocity (circumferential velocity) of upper pressure roller 61 and the surface velocity (circumferential velocity) of rotating lower pressure roller 64 in accordance with the condition of image formation (for example, the type, basis weight, size, and the like of a sheet used for the image formation).

To be more specific, upper pressure roller 61 that follows the driving of lower pressure roller 64 is caused to generate a braking force.

The braking torque of upper pressure roller 61 to be changed is set such that the surface velocity (circumferential velocity) of upper pressure roller 61 is lower by 0.3% to 0.8% than the surface velocity (circumferential velocity) of lower pressure roller 64 serving as a driving roller. Thus, control section 100 prevents the gloss memory from being caused during the fixing process by changing the braking torque of upper pressure roller 61.

The braking torque of upper pressure roller 61 is changed based on the relationship between fixing belt 62, the slip rate of the surface of a sheet, and the gloss memory.

Figure 4:
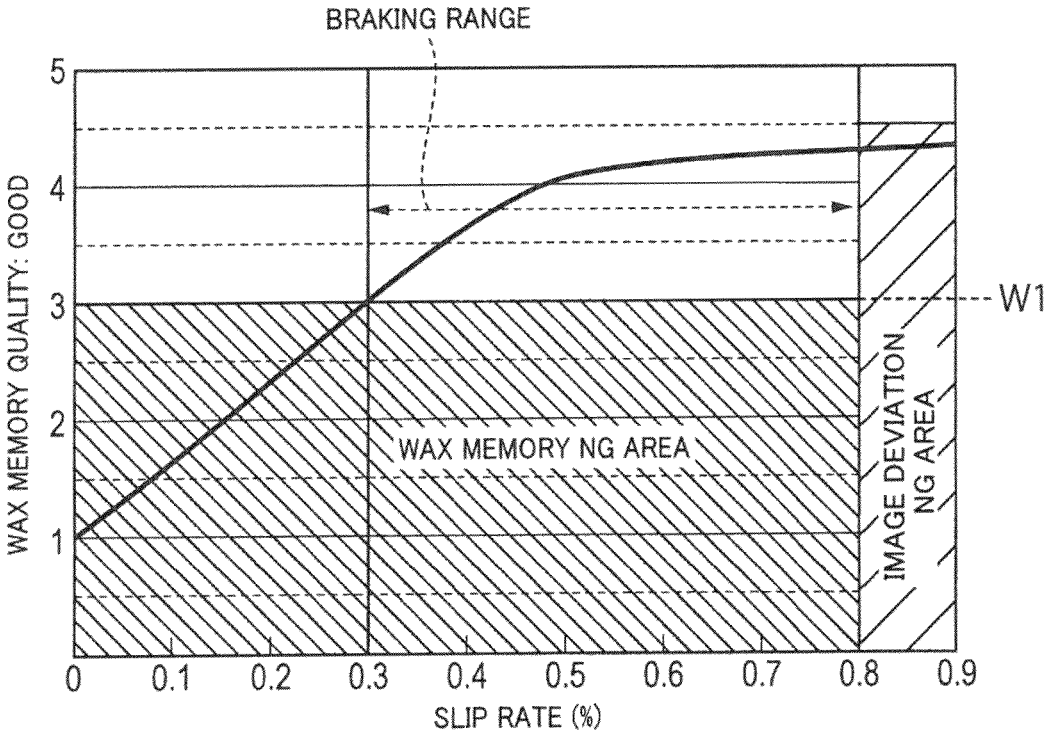
FIG. 4 illustrates a correlation between a slip rate and a gloss memory quality when a fixing process is performed by using the fixing section according to the present invention.

FIG. 4 illustrates a correlation between slip rates and the quality of the gloss memory (also referred to as "wax memory") quality caused on a sheet in the case where the fixing process is performed by using fixing section 60 according to the present invention. It is to be noted that the slip rates of the abscissa represent slip rates of the fixing belt and the surface of a sheet in nip portion N. In addition, the ordinate represents ranks of the quality of the gloss memory caused on the surface of a sheet, and the threshold level thereof is denoted by W1. When the rank is greater than W1, the quality is determined to be favorable and at an acceptable level in which visually recognizable gloss memory is not caused. W1 corresponds to rank 3 representing a rank which causes no practical problem although gloss unevenness may be partly confirmed in the image subjected to the fixing process depending on the sheets after the fixing process. It is to be noted that ranks 1 and 2 are ranks at which gloss unevenness is readily visually recognized on the sheet subjected to the fixing process, rank 4 is a rank representing a quality in which gloss unevenness is visually recognized on sheet subjected to the fixing process depending on the angle, and rank 5 is a rank representing a quality in which no gloss unevenness is caused. It is to be noted that fixing section 60 used to determine the correlation has upper pressure roller 61 having an outer diameter of ϕ70 and a rubber thickness of 20 mm, lower pressure roller 64 having an outer diameter of ϕ70 and a rubber thickness of 1 mm, heating roller 63 having an outer diameter of ϕ58 and a coating of PTFE, and stretching member 68 having an inverted crown shape of ϕ15. In addition, fixing section 60 herein has fixing belt 62 having an outer diameter of ϕ120, a base member of PI, and a surface layer of PFA tube, wherein a linear velocity of 460 mm, a fixing load of 2650N, a belt tensile force of 200N, and a fixing belt control temperature of 160 to 200° C. are adopted. Further, in fixing section 60, lower pressure roller 64 is provided with a heater and the control temperature of the heater is 80 to 120° C., and the toner is an oil-free toner in which wax is contained in toner particles.

As illustrated in FIG. 4, the area corresponding to the slip rates greater than 0.3% is an area where a favorable gloss memory quality can be obtained. In addition, when the slip rate is greater than 0.8%, image deviation occurs in the toner image fixed on the surface of a sheet.

On the basis of such results, control section 100 performs the control such that the surface velocity (circumferential velocity) of upper pressure roller (i.e., the roller on the image side) 61 is lower by 0.3% to 0.8% than the surface velocity of lower pressure roller (i.e., the roller on the non-image side) 64. Such a range is used as a braking range to generate a braking force at upper pressure roller 61.

Figure 5:
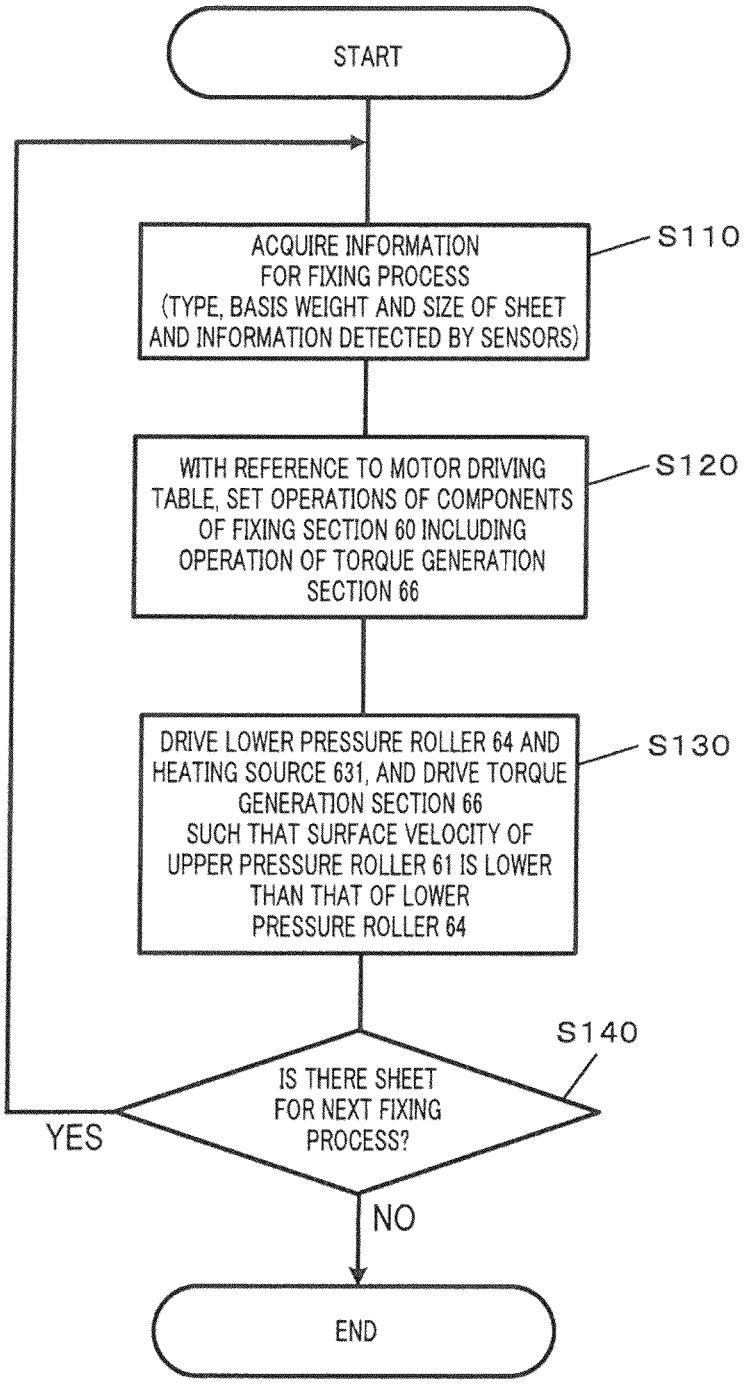
FIG. 5 is a flow chart for describing a control of the fixing section according to the embodiment of the present invention.

FIG. 5 is a flowchart illustrating an exemplary fixing process in the embodiment. The fixing process illustrated in FIG. 5 is achieved when CPU 101 executes a predetermined program stored in ROM 102 upon the start of an image formation process based on image data in image forming apparatus 1.

At step S110, control section 100 acquires, as information for the fixing process, a condition of image formation (for example, the type, basis weight, size, and the like of a sheet used for the image formation), and information from the sensors such as information about the surface temperature of fixing belt 62 inputted from temperature sensor 81. For example, the condition of image formation is automatically set as an image formation mode in accordance with the type, basis weight, and size of the sheet used for the image formation, and stored in RAM 103. Examples of the sheet type include thin sheet, plain sheet, color copy sheet, color sheet, high quality sheet, and various kinds of coated sheets.

At step S120, the operations of heating source 631 of heating roller 63, motor M3 that rotates lower pressure roller 64, and fixing pressure switching mechanism 69 are set in accordance with the image formation mode.

Additionally, at step S120, control section 100 sets a velocity difference between the surface velocity of lower pressure roller 64 (rear side member) and that of fixing belt 62 and upper pressure roller 61 (fixing side member). To be more specific, at step S120, control section 100 uses inputted information and the velocity difference setting table (motor driving table) to set the operation of upper pressure roller 61 via torque generation section 66.

The velocity difference setting table is a table in which information about the fixing process and information for setting the velocity difference between the surface velocity of the fixing side member and that of the rear side member in the nip portion are related to each other. In this example, as the information for setting the velocity difference, the control information of motors M1 and M2 that generate torque to thereby cause upper pressure roller 61 to generate a braking force is associated. This velocity difference setting table is referred to as motor driving table.

By using the motor driving table, control section 100 drives at least one of motors M1 and M2 to generate a braking torque to be imparted to upper pressure roller 61. When receiving the braking torque, upper pressure roller 61 provides a braking force for the rotation of lower pressure roller 64. In addition, control section 100 can drive at least one of motors M1 and M2 by using the motor driving table to generate a fixed torque as an auxiliary driving torque imparted to upper pressure roller 61. When receiving the auxiliary driving torque, upper pressure roller 61 assists the rotation in the conveyance direction with the auxiliary driving force. In addition, control section 100 can cause motors M1 and M2 to generate no torque by using the motor driving table so as to put upper pressure roller 61 into a non-braking state.

The motor driving table is stored in storage section 72. When control section 100 executes the processes, CPU 101 in control section 100 executes the program of the fixing process stored in ROM 102, reads out a required table (motor driving table, sheet type set table, and the like) from storage section 72, and executes the processes.

FIG. 6 illustrates motor driving table 721 as an example of the velocity difference setting table, in which ON or OFF of motors M1 and M2, and ON or OFF of the auxiliary driving force (assist) are set in association with the basis weight of the sheet and the sheet type (sheet type mode). It is to be noted that, in FIG. 6, "ON" of "brake" means that upper pressure roller 61 is caused to generate a braking force, and "ON" of "assist" means that upper pressure roller 61 is caused to generate an auxiliary driving force.

FIG. 7 illustrates a sheet type table as the velocity difference setting table. Specifically, FIG. 7 illustrates sheet type table 722 of select modes associated with respective sheet types of the condition of image formation.

At step S120 back in FIG. 5, control section 100 refers to sheet type table 722 of FIG. 7 and acquires the sheet type mode of the sheet type set in the current select mode in accordance with the inputted sheet type. Then, control section 100 reads out motor driving table 721 illustrated in FIG. 6 from storage section 72 and refers to motor driving table 721 to acquire the control information for the motors associated with the basis weight and the acquired sheet type mode. For example, in the case of a plain sheet having a basis weight of 108 [g/m$^2$], control section 100 acquires "sheet type mode A," "braking (braking force) of both of motors M1 and M2 ("motor 1_ON" and "motor 2_ON" in FIG. 6)," and "non-assist (auxiliary driving force) ("assist_OFF")."

In motor driving table 721 illustrated in FIG. 6, when motors M1 and M2 of "brake" are both set to ON, motors M1 and M2 each generate a fixed braking torque and impart the torque to upper pressure roller 61 via gear mechanism section 67. In addition, when "assist" is set to ON, one of motors M1 and M2 generates a fixed torque and imparts the torque to upper pressure roller 61 via gear mechanism section 67. The torque generated by motors M1 and M2 of "brake" in the "ON" state is 1.5 [N·m]×2, and the torque generated in the case of "assist (auxiliary driving force)" is up to 0.23 [N·m], for example.

At step S130, lower pressure roller 64 and heating source 631 are driven, and motors M1 and M2 of torque generation section 66 are driven based on the control details set in advance to generate a braking torque. The braking torque thus generated is imparted to upper pressure roller 61 so as to cause upper pressure roller 61 to generate a braking force.

To be more specific, at step S130, control section 100 causes motors M1 and M2 to generate a torque set in accordance with the basis weight and type of the sheet on which toner is to be fixed, and imparts the torque to upper pressure roller 61. For example, in the case of a plain sheet having a basis weight of 108 [g/m$^2$], control section 100 drives both of motors M1 and M2 and imparts a torque (braking torque) in a direction opposite the conveyance direction to upper pressure roller 61. As a result, in nip portion N, upper pressure roller 61 located on the internal circumference side of fixing belt 62 and fixing belt 62 exert a braking force on the rotation of upper pressure roller 61. Thus, by the braking force generated by upper pressure roller 61 that rotates following the rotation of lower pressure roller 64, a velocity difference between the surface velocity of fixing belt 62 (as well as upper pressure roller 61) and that of lower pressure roller 64 is set. The velocity difference is set such that the surface velocity of upper pressure roller 61 is lower than that of lower pressure roller 64.

Here, the surface velocity is set such that the surface velocity of upper pressure roller 61 is lower than that of lower pressure roller 64 by 0.3% to 0.8%.

In addition, when driving both of motors M1 and M2 on the basis of motor driving table 721, control section 100 activates the motors at different timings. In this manner, it is possible to prevent the oscillation which is generated when motors M1 and M2 are simultaneously activated, and thus to smoothly impart a torque to upper pressure roller 61. Also, in stopping motors M1 and M2, by shifting the stopping timings so as to sequentially stop the motors, the torque being imparted to upper pressure roller 61 can be smoothly changed to zero.

It is to be noted that when control section 100 acquires at step S120 "assist" ON in accordance with the type of the sheet on which toner is to be fixed (for example, in the case of a thin sheet), control section 100 drives one of motors M1 and M2 to generate a predetermined torque in the direction same as the conveyance direction caused by the driving of lower pressure roller 64.

In other words, control section 100 imparts an auxiliary driving force to upper pressure roller 61 via torque generation section 66.

At step S140, control section 100 determines whether there is information of the next sheet on which unfixed toner has been formed. When such information is obtained, the process is returned to step S110; when there is no such information, the process is terminated.

As described above, in the present embodiment, by control section 100, fixing section 60 brakes fixing belt 62 on the fixing side, i.e., on the image side, via upper pressure roller 61 to set the surface velocity of fixing belt 62 such that the surface velocity of fixing belt 62 is lower than that of lower pressure roller 64 by 0.3% to 0.8%.

With the above-mentioned configuration, in nip portion N, a shearing force is generated between fixing belt 62 and the image face on the sheet, and thus the separation performance between the surface of fixing belt 62 and the surface of the sheet is improved, i.e., the fixing face of the sheet can be separated from the surface of fixing belt 62 more easily. Therefore, even in the case where wax is somewhat unevenly adhered on the surface of fixing belt 62 after the end of the fixing process of the preceding sheet, it is possible to uniformly separate the sheet from fixing belt 62 owing to the improved separation performance irrespective of a portion of fixing belt 62 with a large amount of wax and a portion thereof with a small amount of wax. Thus, it is possible to prevent the generation of the gloss memory that exercise an influence on the fixing process for the next sheet.

In addition, when a thin sheet having a basis weight of 60 to 80 [g/m$^2$] is conveyed to pass through nip portion N, control section 100 drives torque generation section 66 to generate a torque for imparting the auxiliary driving force to upper pressure roller 61. Thus, the deflection of the sheet passing through nip portion N can be prevented, and toner can be favorably fixed without causing wrinkling of sheet, gloss unevenness, image deviation and the like.

While the above-mentioned fixing section 60 has the function for imparting a braking torque to upper pressure roller 61 to cause upper pressure roller 61 to generate a braking force, and the function for imparting an auxiliary driving torque (assist) to upper pressure roller 61 so as to generate an auxiliary driving force, the assisting function may be omitted. In that case, in the image forming apparatus having the above-mentioned configuration, control section 100 may perform the fixing process by using motor driving table 723 of FIG. 8 in place of motor driving table 721 used at step S120.

It is to be noted that, while, in the above-mentioned embodiment, the braking torque generated in each of motors M1 and M2 for causing upper pressure roller 61 to generate the braking force to be exerted on lower pressure roller 64 driven in the conveyance direction has a fixed value, the present invention is not limited thereto. It is also possible to control motors M1 and M2 to generate braking torques differing in magnitude in accordance with the type, basis weight, size and the like of the sheet, and to impart the torques differing in magnitude combined together as the braking torque to upper pressure roller 61. With this configuration, the velocity difference between upper pressure roller 61 and fixing belt 62, and lower pressure roller 64 (corresponding to sheet S) can be more finely set in a stepwise manner in accordance with the type, basis weight, size and the like of the sheet. In this case, the velocity difference thereof is set such that the surface velocity of upper pressure roller 61 and fixing belt 62 on the fixing side is lower by 0.3% to 0.8% than that of lower pressure roller 64 on the non-image side, i.e., the rear side.

In other words, the magnitude of the braking force generated at upper pressure roller 61 by the braking torque generated by motors M1 and M2 can be changed, and many braking amounts differing in magnitude can be set for the sheets to be conveyed.

For example, the braking torque of motor M1 is set to 0.08 and 0.16 [N·m], and the braking torque of motor M2 is set to 0.05 and 0.1 [N·m]. By combining the braking torques, control section 100 can impart braking torques of 0.05, 0.08, 0.1, 0.13, 0.16, 0.18, 0.21, and 0.26 [N·m] in the direction opposite the conveyance direction to upper pressure roller 61 via torque generation section 66. Thus, upper pressure roller 61 can exert many braking forces differing in magnitude on lower pressure roller 64, i.e., sheet S. As described above, the braking torque includes a plurality of changeable torques differing in magnitude.

For example, when control section 100 acquires "ON" of motors M1 and M2 from motor driving table 721 illustrated in FIG. 6 during the fixing process, control section 100 causes each of motors M1 and M2 to generate an individually set braking torque, and imparts the torque to upper pressure roller 61. With this configuration, in the fixing process, the braking amount generated by upper pressure roller 61 can be set more finely, and many velocity differences differing in magnitude can be set for the velocity difference between the surface velocity of upper pressure roller 61 and that of lower pressure roller 64. Thus, an appropriate braking amount can be set in accordance with the type, basis weight, size and the like of the sheet to smoothly separate fixing belt 62 and the sheet, and as a result, gloss memory can be prevented.

Embodiment 2

FIG. 9 illustrates an exemplary motor driving table for use in a fixing process of an image forming apparatus according to embodiment 2 of the present invention. In motor driving table 724 illustrated in FIG. 9, surface temperatures of fixing belt 62, sheet types, and amounts of braking torque generated by upper pressure roller 61 are associated with one another. In this instance, a plurality of braking torques differing in magnitude generated by motors M1 and M2 are set as "non" braking, "high" braking, "intermediate" braking, and "low" braking. For example, "low" braking is set to 0.05 [N·m], "intermediate" braking to 0.1 [N·m], and "high" braking to 0.16 [N·m]. It is to be noted that the image forming apparatus according to embodiment 2 and the image forming apparatus according to embodiment 1 have the same configuration, function, and effect except that the motor driving tables used for setting the braking torque are different. Therefore, the components corresponding to those of image forming apparatus 1 will be denoted with the same names and reference numerals, and their descriptions will not be made. In the following, setting of braking torque will be mainly described.

In the image forming apparatus of embodiment 2, control section 100 refers to motor driving table 724 illustrated in FIG. 9 to control the braking torque to be imparted to upper pressure roller 61 in the same process as step S120 of FIG. 5 during the fixing process.

Specifically, in embodiment 2, temperature sensor 81 detects the surface temperature of fixing belt 62, and control section 100 refers to motor driving table 724 and changes the magnitude of the torque generated by motors M1 and M2 so as to generate the braking torque corresponding to the temperature detected by temperature sensor 81. Control section 100 imparts the torque thus generated to upper pressure roller 61 to generate the braking torque.

Now, the surface temperature of fixing belt 62 will be described. In fixing section 60 of image forming apparatus 1, when the surface temperature of fixing belt 62 is high (for example, 190° C. or above) and a sheet is sandwiched at nip portion N, wax in unfixed toner on the sheet is likely to dissolve and exude on the surface of the sheet. As a result, the surface of fixing belt 62 contacting the surface of the sheet is likely to slip. Therefore, in the case where the surface temperature of fixing belt 62 is high (for example 190° C. or above), the slip rate of 0.3 to 0.8% of the surface velocity of the sheet (which corresponds to the circumferential velocity of lower pressure roller 64) and fixing belt 62 can be ensured even when the braking torque generated by upper pressure roller 61 is reduced in comparison with the case where the surface temperature is low (for example, lower than 190° C.). Thus, it is possible to prevent the generation of the gloss memory that exercise an influence on the fixing process for the next sheet.

While, in embodiment 2, control section 100 controls torque generation section 66 to generate a braking force at upper pressure roller 61 by switching between the four variations, "non" braking, "high" braking, "intermediate" braking, "low" braking in accordance with the type and surface temperature of the sheet, the present invention is not limited thereto. For example, the number of the magnitude levels of the braking torque generated by upper pressure roller 61 for the switching (in FIG. 9, "non," "high," "intermediate," and "low") may be reduced to three or less, or increased to five or more.

Embodiment 3

FIG. 10 illustrates an exemplary motor driving table for use in a fixing process of an image forming apparatus according to embodiment 3. In motor driving table 725 illustrated in FIG. 10, amounts of toner adhered to a sheet (toner adhesion amount) and amounts of braking torque generated by torque generation section 66 are associated with one another. In this instance, a plurality of braking torques differing in magnitude generated by motors M1 and M2 of torque generation section 66 in accordance with the toner adhesion amount are set as "high" braking, "intermediate" braking, and "low" braking. For example, "low" braking is set to 0.05 [N·m], "intermediate" braking to 0.1 [N·m], and "high" braking to 0.16 [N·m]. It is to be noted that the image forming apparatus according to embodiment 2 and the image forming apparatus according to embodiment 1 have the same configuration, function, and effect except that the motor driving tables used for setting the braking torque are different. Therefore, in the following, only setting of braking torque will be described, and other points will not be described.

In the image forming apparatus of embodiment 3, control section 100 refers to motor driving table 725 illustrated in FIG. 10 to control the braking torque to be imparted to upper pressure roller 61 in the same process as step S120 of FIG. 5 during the fixing process.

Specifically, control section 100 changes the braking torque generated by torque generation section 66 in accordance with information representing the state of toner on sheet S with reference to the motor driving table, and imparts the torque to upper pressure roller 61. The information representing the state of toner on sheet S includes the adhesion amount of the toner and the toner coverage amount representing the ratio of the toner covering the sheet. The information representing the state of the toner is computed by control section 100 with use of image data.

For example, when the toner adhesion amount is 0 to 5 [g/m$^2$] and the ratio of adhered toner covering the surface of a sheet (toner coverage rate) is 0 to 75%, "high" braking is set, and when the toner adhesion amount is 0 to 5 [g/m$^2$] and the toner coverage rate is 76% to 100%, "intermediate" braking is set. In addition, when the toner adhesion amount is 5.1 to 8 [g/m$^2$] and the rate of toner covering the surface of a sheet (toner coverage rate) is 0 to 50%, "high" braking is set, and when the toner adhesion amount is 5.1 to 8 [g/m$^2$] and the toner coverage rate is 51 to 75%, "intermediate" braking is set.

Now, the toner adhesion amount on the sheet will be described. When the amount of unfixed toner on the sheet is large, in other words, when the image is deep, wax contained in the unfixed toner reduces the coefficient of friction [μ] between the sheet and fixing belt 62. Similarly, when the toner coverage rate is high, in other words, when toner widely covers the surface of the sheet, wax contained in the unfixed toner reduces the coefficient of friction [μ] between the sheet and fixing belt 62. When the coefficient of the friction in nip portion N is small, the surfaces of the sheet and fixing belt 62 are likely to slip. Thus, the slip rate of 0.3 to 0.8% of the surface velocity of the sheet (which corresponds to the circumferential velocity of lower pressure roller 64) and fixing belt 62 can be ensured even when the braking torque generated by upper pressure roller 61 is reduced.

While, in embodiment 3, control section 100 controls torque generation section 66 to generate braking force at upper pressure roller 61 by switching between the four variations, "non" braking, "high" braking, "intermediate" braking, and "low" braking in accordance with the type and surface temperature of the sheet, the present invention is not limited thereto. For example, the number of the magnitude levels of the braking torque for the switching may be reduced to three or less, or increased to five or more.

While, in embodiments 1 to 3, torque generation section 66 causes motors M1 and M2 such as DC brushless motors to generate a reverse rotation torque, and imparts the torque to upper pressure roller 61, the present invention is not limited thereto. Alternatively, a configuration may be employed in which an electric current is applied to the motors by DC brushless motors as in the above-mentioned case to increase the shaft holding force so that a braking force acts on upper pressure roller 61. Torque generation section 66 may have any configuration insofar as torque generation section 66 imparts a torque to upper pressure roller 61 so as to brake lower pressure roller 64 driven in the conveyance direction. For example, upper pressure roller 61 may be composed of a so-called electromagnetic brake such as a powder brake that transmits and controls a torque by using magnetic powder as a medium.

For example, a rotational axis of upper pressure roller 61 and a fixing shaft are concentrically disposed with a powder gap interposed therebetween, and the rotational axis is supported by a bearing so as to be rotatable relative to the fixing shaft. Highly-permeable magnetic metal powder (powder) is contained in the powder gap, and an exciting coil is arranged on the outer periphery of the powder gap in order to allow magnetic flux to pass through the magnetic metal powder. In a powder brake, when upper pressure roller 61 rotates in a non-excitation state, the magnetic metal powder is pushed to the operation surface of the rotational axis of upper pressure roller 61 due to centrifugal force, and the rotational axis is not coupled to the fixing shaft. When the coil is energized, the magnetic metal powder is coupled in a chain-like form along the generated magnetic flux, and the coupling force of the magnetic metal powder and the frictional force between the magnetic metal powder and the operation surface generated at this time transmit the torque of the rotational axis to the fixing shaft. Thus, a braking torque is imparted to the rotational axis. In this manner, a velocity difference can be set between upper pressure roller 61 and lower pressure roller 64, which compose nip portion N with fixing belt 62 interposed therebetween, such that the surface velocity (circumferential velocity) of upper pressure roller 61 is lower than that of lower pressure roller 64. Thus, it is possible to prevent the generation of the gloss memory that exercise an influence on the fixing process for the next sheet.

It is to be noted that the torque generated by the powder brake in this instance is set in the same manner as the braking amount in the above-mentioned embodiments, which is set based on the type and basis weight of the sheet, as well as the surface temperature of the sheet and the amount of the toner adhered on the sheet, and thus the same effect as in the above-mentioned embodiments is achieved. In addition, the torque generation section may be composed of a hysteresis brake or the like to impart a torque to upper pressure roller 61.

In addition, in each embodiment, the magnitude of the braking torque generated by motors M1 and M2 may be steplessly changed. The "high," "intermediate," and "low" brakings in embodiments 2 and 3 are further divided, and brakes differing in magnitude are generated by upper pressure roller 61. For example, one of motors M1 and M2 is PWM-controlled to generate an auxiliary driving torque (assist) while the other of the motors is caused to generate a braking torque, and the auxiliary driving torque (assist) and the braking torque thus generated are combined in the control operation. The braking torque generated by the other of the motors is adjusted by causing one of the motors to generate an auxiliary driving torque in a steplessly changeable manner, and imparted to upper pressure roller 61 via gear mechanism section 67. Thus, upper pressure roller 61 is caused to generate a braking force having an appropriate magnitude in accordance with factors such as the type, basis weight, and size of the sheet, the surface temperature, toner adhesion amount, and toner coverage rate of fixing belt 62. By reducing the surface velocity of upper pressure roller 61 such that the surface velocity of upper pressure roller 61 is lower than that of lower pressure roller 64 in the above mentioned manner, separation of sheets and fixing belt 62 can be further facilitated and the releasability can be increased. Thus, it is possible to prevent the generation of the gloss memory that exercise an influence on the fixing process for the next sheet. Here, in fixing section 60 of image forming apparatus 1 according to the present embodiment, the torque of motor M3 that drives lower pressure roller 64 occasionally decreases with time under the influence of factors such as the thermal expansion of upper pressure roller 61. In that case, with the configuration in which the braking torque can be steplessly changed, it is possible to maintain an appropriate braking force generated by upper pressure roller 61 by feeding back the torque of lower pressure roller 64 to detect the decrease of the torque of lower pressure roller 64 and using the detection results. Thus, similarly to the above-described effect of the braking force generated by upper pressure roller 61, the generation of the gloss memory can be prevented.

In addition, while the main driving source for conveying sheets from nip portion N is motor M3 of lower pressure roller 64, and upper pressure roller 61 is driven by lower pressure roller 64 via fixing belt 62 in the above-mentioned image forming apparatus, the present invention is not limited thereto. Alternatively, a configuration may be employed in which, in order to eject sheets, upper pressure roller 61 and lower pressure roller 64 configuring nip portion N are both driven in the conveyance direction such that the surface velocity of upper pressure roller 61 as the roller on the image side is lower than that of lower pressure roller 64 as the roller on the non-image side. Such an exemplary configuration will be described below.

Embodiment 4

An image forming apparatus according to embodiment 4 has a configuration in which upper pressure roller 61 and lower pressure roller 64 are both driven to convey sheets in image forming apparatus 1 having the above-mentioned configuration, and controls both of upper pressure roller 61 and lower pressure roller 64 to set a velocity difference between them. To be more specific, at least one of motors M1 and M2, and motor M3 are used to convey sheets in a nipping manner at nip portion N.

At this time, one of motors M1 and M2 and motor M3 are controlled to set a velocity difference between the surface velocity of upper pressure roller 61 and that of lower pressure roller 64. To be more specific, the velocity difference is set such that the surface velocity of upper pressure roller 61 is lower than that of lower pressure roller 64 so as to facilitate the separation of sheets and the fixing belt, thereby increasing the releasability. Alternatively, the velocity difference may be set such that the surface velocity of lower pressure roller 64 is higher than that of upper pressure roller 61. Thus, it is possible to prevent the generation of the gloss memory that exercise an influence on the fixing process for the next sheet.

Embodiment 5

Incidentally, the braking torque required for ensuring the slip rate of 0.3 to 0.8% of the surface velocity of the sheet (which corresponds to the circumferential velocity of lower pressure roller 64) and fixing belt 62 varies depending on the toner adhesion amount at each position in the sheet conveyance direction (vertical scanning direction) on the sheet. Therefore, in the case of a toner image on a sheet including a portion where the toner adhesion amount is large and a portion where the toner adhesion amount is small in the sheet conveyance direction, it may be difficult to ensure a high gloss memory quality by the switching of braking torques in accordance with the toner adhesion amount of the whole sheet.

Figure 11:
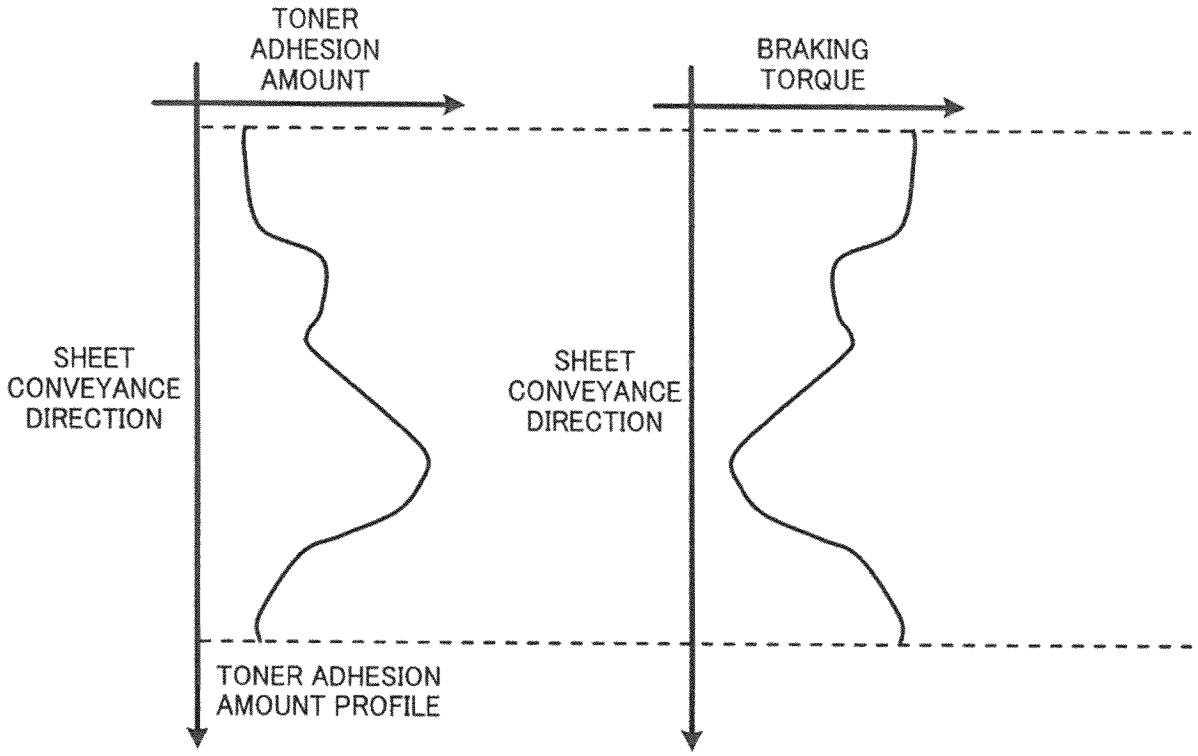
FIG. 11 illustrates a relationship between a toner adhesion amount profile and a braking torque according to embodiment 5 of the present invention.

Under such a circumstance, in an image forming apparatus according to embodiment 5, control section 100 (data computing means) computes, for each position in the sheet conveyance direction on the sheet, an integrated value (data) of the toner adhesion amount at each position in the sheet width direction (horizontal scanning direction) perpendicular to the sheet conveyance direction to create a toner adhesion amount profile. At the time when positions in the sheet conveyance direction on the sheet pass through fixing nip portion N, velocity difference setting means 600 imparts, to fixing belt 62 and upper pressure roller 61 (fixing side member), braking torques corresponding to the integrated value of the toner adhesion amount at respective positions computed by control section 100 as illustrated in FIG. 11. To be more specific, as the integrated value of the toner adhesion amount increases, the sheet and the surface of fixing belt 62 become more likely to slip, and therefore the braking torque to be imparted to fixing belt 62 and upper pressure roller 61 is reduced with the increase of the integrated value. Meanwhile, as the integrated value of the toner adhesion amount decreases, the sheet and the surface of fixing belt 62 become less likely to slip, and therefore the braking torque to be imparted to fixing belt 62 and upper pressure roller 61 is increased with the decrease of the integrated value.

With the configuration of embodiment 5, even in the case of a toner image on a sheet including a portion where the toner adhesion amount is large and a portion where the toner adhesion amount is small in the sheet conveyance direction, since the switching of braking torques according to the toner adhesion amount is performed at and around fixing nip portion N, a high gloss memory quality can be ensured.

Figure 12:
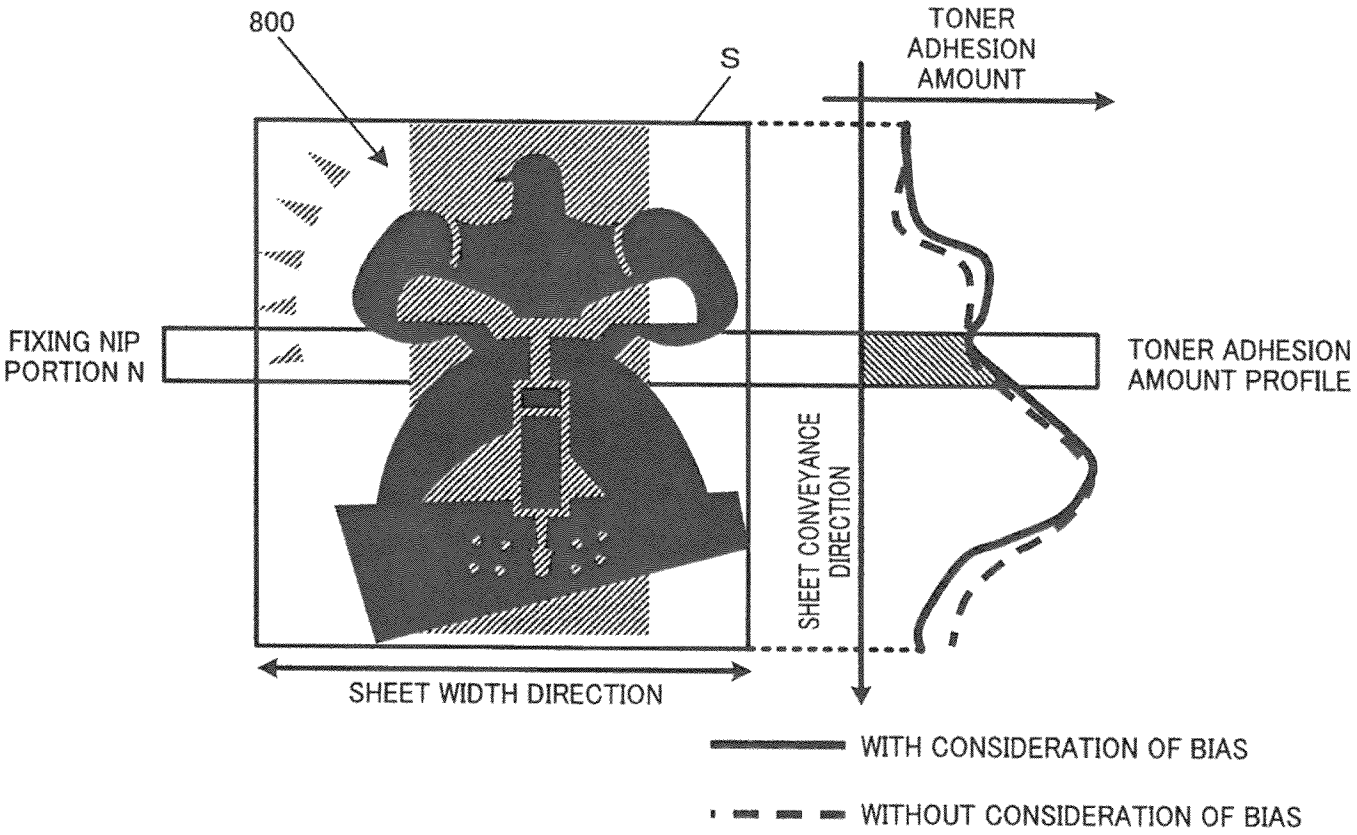
FIG. 12 illustrates a relationship between a toner image on a sheet and a toner adhesion amount profile according to embodiment 5 of the present invention.

FIG. 12 illustrates a relationship between toner image 800 on sheet S and a toner adhesion amount profile (dotted line) according to embodiment 5. In toner image 800 illustrated in FIG. 12, the toner adhesion amount at each position is biased in the sheet width direction. In the case where such a bias is caused (for example, in the case where the standard deviation of the toner adhesion amount in the sheet width direction is greater than a predetermined value), the greater the degree of the bias, the more reduced the computed toner adhesion amount by correction as shown by a toner adhesion amount profile (solid line). For example, a predetermined value corresponding to the degree of bias is subtracted from the computed toner adhesion amount. Alternatively, a predetermined coefficient (<1) corresponding to the degree of bias and the computed toner adhesion amount are integrated. The degree of bias of the toner adhesion amount in the sheet width direction is considered for the following reason. Specifically, at a position where the toner adhesion amount is biased, the sheet and the surface of fixing belt 62 are less likely to slip. Accordingly, the toner adhesion amount at the position where the toner adhesion amount is biased is underestimated, and the braking torque is increased by the underestimated amount to ensure the slip rate of 0.3 to 0.8%. With this configuration, even when there exist a position where the toner adhesion amount is biased and a position where the toner adhesion amount is not biased in the sheet width direction, since the switching of braking torques in consideration of the degree of bias of the toner adhesion amount is performed in the sheet conveyance direction, a high gloss memory quality can be ensured.

Figure 13:
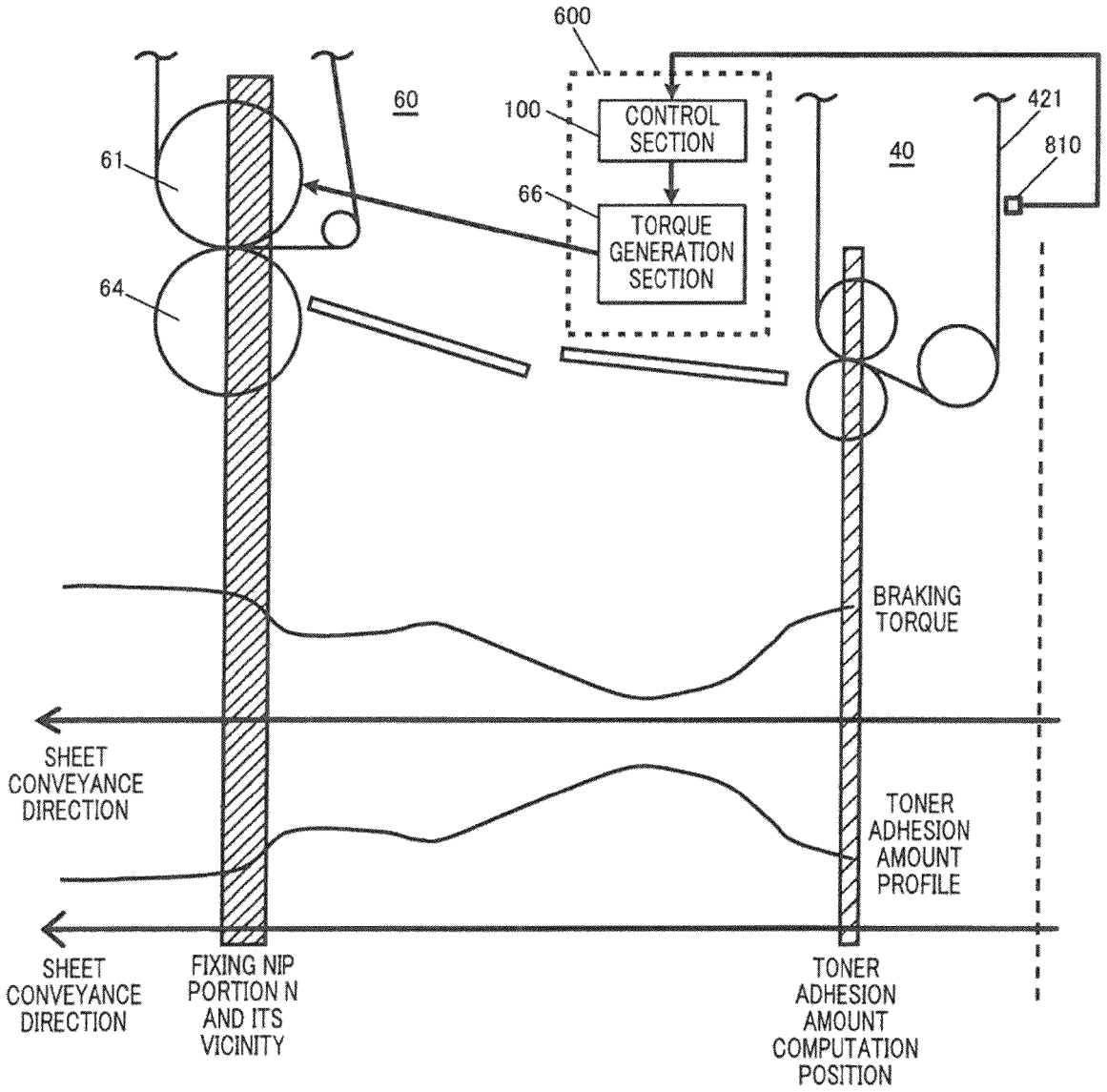
FIG. 13 illustrates a relationship between a timing at which the toner adhesion amount profile is created and a position of a fixing nip portion according to embodiment 5 of the present invention.

FIG. 13 illustrates a relationship between a timing at which the toner adhesion amount profile is created and the position of fixing nip portion N according to embodiment 5. In embodiment 5, toner adhesion amount sensor 810 that detects the toner adhesion amount of a toner image formed on intermediate transfer belt 421 in the horizontal scanning direction is disposed on the outer peripheral surface side of intermediate transfer belt 421 (intermediate transfer member). At a timing when a toner image primary-transferred on intermediate transfer belt 421 is secondary-transferred to sheet S, control section 100 computes, on the basis of results of the detection by toner adhesion amount sensor 810, the integrated value of the toner adhesion amount at each position in the sheet width direction for each position in the sheet conveyance direction on the sheet, thereby creating a toner adhesion amount profile. Thereafter, when the positions in the sheet conveyance direction on the sheet pass through fixing nip portion N, velocity difference setting means 600 including control section 100 and torque generation section 66 imparts, to fixing belt 62 and upper pressure roller 61, braking torques corresponding to the integrated value of the toner adhesion amount at respective positions on the basis of the created toner adhesion amount profile.

It is to be noted that, while an exemplary case where the toner adhesion amount profile is created on the basis of the toner image formed on intermediate transfer belt 421 has been described in the above-mentioned embodiment 5, the present invention is not limited to this. For example, the toner adhesion amount profile may be created on the basis of image data corresponding to a toner image on the sheet (image data sent from external apparatuses and the like). In addition, the toner adhesion amount profile may be created on the basis of a toner image formed on photoconductor drum 413 (photoconductor). In that case, the toner adhesion amount profile may be created by computing the integrated value of the toner adhesion amount at each position in the sheet width direction for each position in the sheet conveyance direction on the sheet, on the basis of the results detected by toner adhesion amount sensor 810 disposed on the outer peripheral surface side of photoconductor drum 413. Further, the toner adhesion amount profile may be created on the basis of writing data for light exposure device 411, a developing current that flows during a developing operation of developing device 412, or the like.

In addition, in the above-mentioned embodiment 5, the toner adhesion amount profile may be created by computing the average value of the toner adhesion amount at each position in the sheet width direction for each position in the sheet conveyance direction on the sheet. In addition, the toner adhesion amount profile may be created by computing the ratio of a position where the toner adhesion amount is greater than a predetermined adhesion amount with respect to positions in the sheet width direction for each position in the sheet conveyance direction on the sheet. In each case, as the average value or ratio of the toner adhesion amount increases, the sheet and the surface of fixing belt 62 become more likely to slip, and therefore the braking torque to be imparted to fixing belt 62 and upper pressure roller 61 is reduced with the increase of the average value or ratio of the toner adhesion amount. On the other hand, as the average value or ratio of the toner adhesion amount decreases, the sheet and the surface of fixing belt 62 become less likely to slip, and therefore the braking torque to be imparted to fixing belt 62 and upper pressure roller 61 is increased with the decrease of the average value or ratio of the toner adhesion amount.

Figure 14:
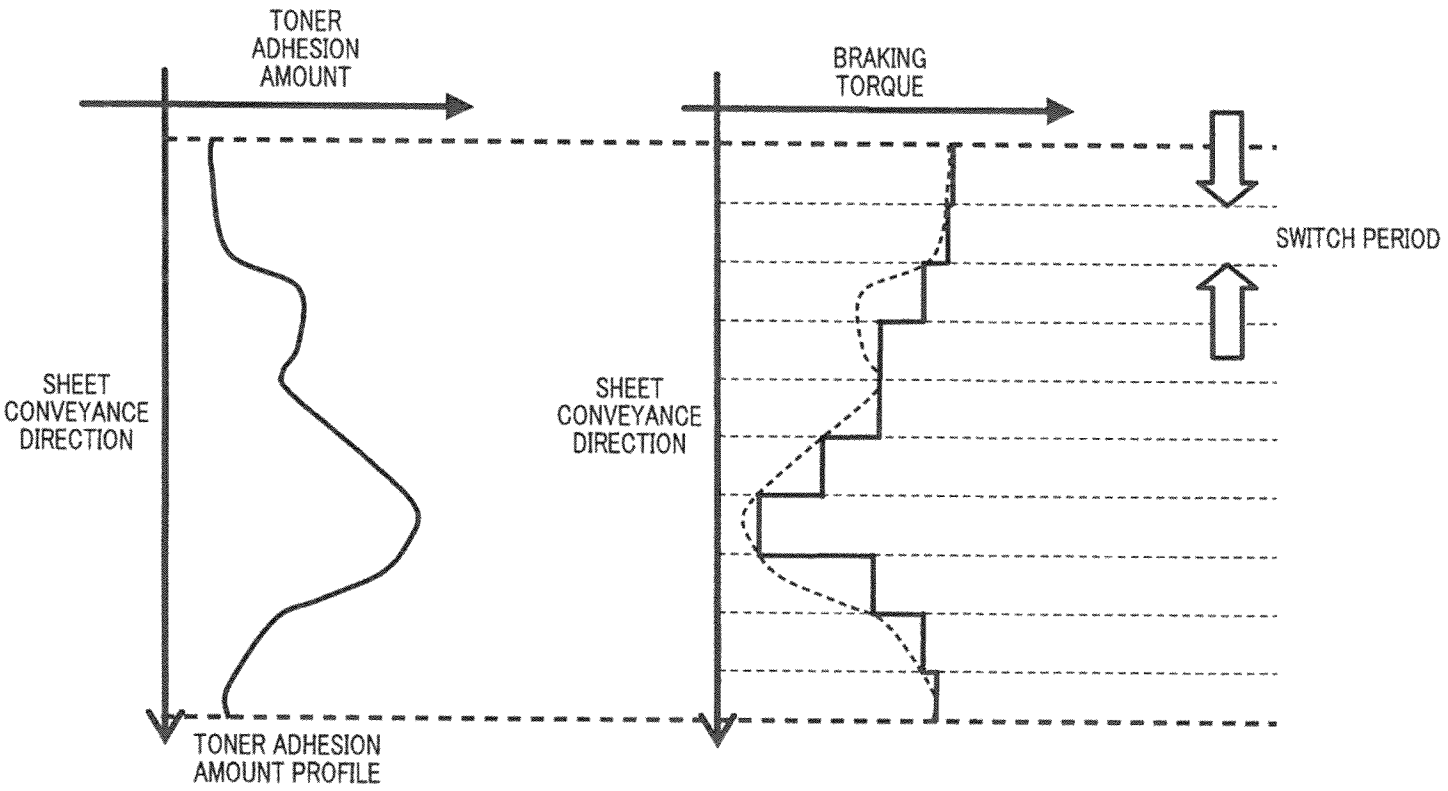
FIG. 14 illustrates a relationship between a toner adhesion amount profile and a braking torque according to embodiment 5 of the present invention.

In addition, in the above-mentioned embodiment 5, the braking torque imparted to fixing belt 62 and upper pressure roller 61 in the sheet conveyance direction may be switched for each switch period (for example, 0.5[s]) in a stepwise manner as illustrated in FIG. 14. In this instance, it is possible to set the braking torque imparted to fixing belt 62 and upper pressure roller 61 at a maximum value in a switch period of the toner adhesion amount profile in accordance with a minimum value of the toner adhesion amount in the period. With this configuration, even when the responsiveness of gear mechanism section 67 that composes torque generation section 66 is poor since, for example, the number of the gear groups that transmit the rotation of motors M1 and M2 to upper pressure roller 61 is large, the braking torque required for each position in the sheet conveyance direction on the sheet can be imparted to fixing belt 62 and upper pressure roller 61 without response delay.

In addition, while an exemplary case where the integrated value of the toner adhesion amount at each position in the sheet width direction is computed for each position in the sheet conveyance direction on the sheet to create the toner adhesion amount profile has been described in the above-mentioned embodiment 5, the present invention is not limited to this. For example, after the integrated value of the toner adhesion amount at each position in the sheet width direction is computed, velocity difference setting means 600 may use the computed integrated value of the toner adhesion amount in real time and impart the braking torque corresponding to the integrated value at the time when each position in the sheet conveyance direction on the sheet passes through fixing nip portion N. In other words, it is not absolutely necessary to create the toner adhesion amount profile as a result of the computation of the integrated value of the toner adhesion amount.

In addition, when duplex printing is performed in image forming apparatus 1 in the above-mentioned embodiment 5, specifically, when fixing at fixing nip portion N is performed on the first surface of a sheet (for example, a surface on which an image is formed at first) and then on the second surface of the sheet (for example, a surface on which an image is formed next), the braking torque to be imparted may be set in consideration of the toner adhesion amount on the first surface.

To be more specific, control section 100 computes the integrated value of the toner adhesion amount at each position in the sheet width direction for each position in the sheet conveyance direction on first and second surfaces of a sheet, and stores the value thus computed in storage section 72. At the time when the positions in the sheet conveyance direction on the second surface of the sheet pass through fixing nip portion N, velocity difference setting means 600 refers to storage section 72, and imparts, to fixing belt 62 and upper pressure roller 61, braking torques corresponding to the integrated value of the toner adhesion amount at respective positions on the first and second surfaces computed by the control section 100.

At the time when each position in the sheet conveyance direction on the second surface of the sheet passes through fixing nip portion N, when toner exists on the first surface, the first surface of the sheet and the surface of lower pressure roller 64 are more likely to slip. That is, lower pressure roller 64 is more likely to slip in the direction opposite the rotational direction of lower pressure roller 64. Therefore, when duplex printing is performed in image forming apparatus 1, the braking torque to be imparted to fixing belt 62 and upper pressure roller 61 is increased in comparison with the case of one-side printing.

Figure 15:
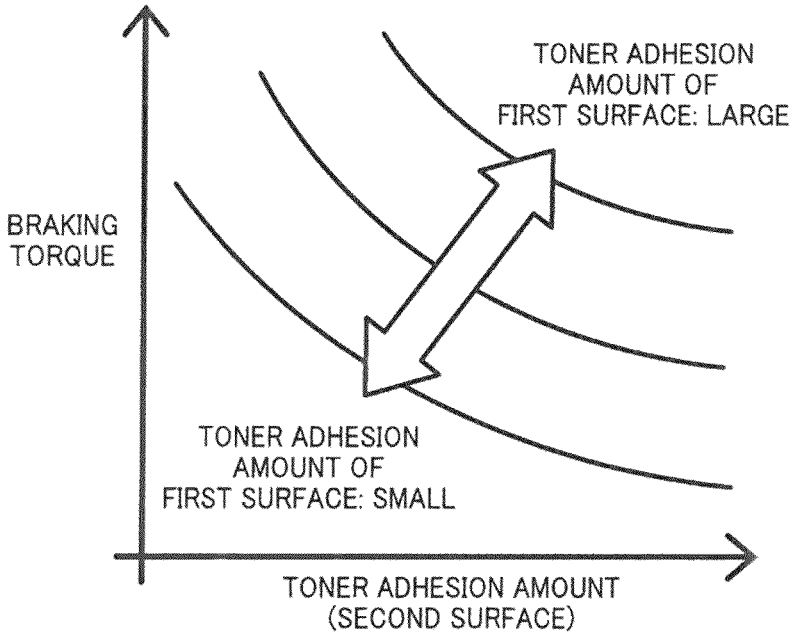
FIG. 15 illustrates a relationship between a toner adhesion amount and a braking torque at the time of duplex printing according to embodiment 5 of the present invention.

As illustrated in FIG. 15, as the toner adhesion amount on the first surface increases, the first surface of the sheet and the surface of lower pressure roller 64 become more likely to slip, and therefore the braking torque to be imparted to fixing belt 62 and upper pressure roller 61 is increased with the increase of the toner adhesion amount on the first surface. With this configuration, in the case of duplex printing performed in image forming apparatus 1, even when the toner adhesion amount on the first surface of the sheet is large, since the switching of braking torques in consideration of the toner adhesion amount on the first surface is performed at each position in the sheet conveyance direction on the second surface of the sheet, a high gloss memory quality can be ensured.

It is to be noted that, in the above-mentioned embodiments, in the case of a mixed mode where sheets having different sheet types are subjected to the fixing process, control section 100 refers to the motor driving tables, and switches the on or off of the braking torque for each sheet to be conveyed so that a braking torque appropriate for each sheet to be conveyed is generated.

It should be understood by those skilled in the art that various modifications, combinations, sub-combinations and alterations may occur depending on design requirements and other factors in so far as they are within the scope of the appended claims or the equivalents thereof.

What is claimed is:

1. A fixing device comprising:

a rotatable fixing side member; and a rear side member that rotates in pressure contact with an outer peripheral surface of the fixing side member, the rear side member forming a fixing nip portion for conveying a sheet on which a toner image is formed in a sandwiching manner in conjunction with the fixing side member, wherein velocity difference setting means for setting a velocity difference between a surface velocity of the rear side member and a surface velocity of the fixing side member is provided such that the surface velocity of the fixing side member is lower than the surface velocity of the rear side member, and the rear side member and the fixing side member rotate with a velocity difference set by the velocity difference setting means, wherein the velocity difference setting means sets the velocity difference such that the surface velocity of the fixing side member is lower than the surface velocity of the rear side member by 0.3 to 0.8%.

2. The fixing device according to claim 1, further comprising:

a driving section that drives the rear side member into rotation in a conveyance direction; wherein the velocity difference setting means sets the velocity difference by imparting a braking torque for braking the rotation of the rear side member in the conveyance direction to the fixing side member.

3. The fixing device according to claim 2, wherein the braking torque includes a plurality of changeable torques differing in magnitude, and the velocity difference setting means selects the braking torque from the changeable torques and imparts the braking torque thus selected to the fixing side member.

4. The fixing device according to claim 3, wherein the velocity difference setting means includes a motor switchable between a generation of the braking torque, a generation of the auxiliary driving torque that is a fixed torque, and a stoppage.

5. The fixing device according to claim 4, wherein the motors differ in at least one of an activation timing and a stop timing.

6. The fixing device according to claim 2, wherein the velocity difference setting means is capable of imparting to the fixing side member an auxiliary driving torque for rotating the fixing side member along with the rotation of the rear side member in addition to the braking torque, and the braking torque and the auxiliary driving torque are changeable.

7. The fixing device according to claim 6, wherein the velocity difference setting means includes a plurality of the motors, and the motors operate separately or together to impart the braking torque to the fixing side member.

8. The fixing device according to claim 2, wherein the braking torque is changed in accordance with a sheet type.

9. The fixing device according to claim 2, wherein the braking torque is changed in accordance with a temperature of the fixing side member.

10. The fixing device according to claim 2, wherein the braking torque is changed in accordance with an amount of a toner adhered on the sheet.

11. The fixing device according to claim 2, wherein the velocity difference setting means includes an electromagnetic brake section that is changeable by an input current or an input voltage, the electromagnetic brake section imparting a braking force to the fixing side member.

12. The fixing device according to claim 1, wherein the velocity difference setting means includes a fixing side driving section and a rear side driving section which respectively drive the fixing side member and the rear side member into rotation in a separate manner, the velocity difference setting means setting the velocity difference by driving the fixing side driving section and the rear side driving section.

13. An image forming apparatus comprising the fixing device according to claim 1.

14. A fixing device comprising:

a rotatable fixing side member; and a rear side member that rotates in pressure contact with an outer peripheral surface of the fixing side member, the rear side member forming a fixing nip portion for conveying a sheet on which a toner image is formed in a sandwiching manner in conjunction with the fixing side member, wherein velocity difference setting means for setting a velocity difference between a surface velocity of the rear side member and a surface velocity of the fixing side member is provided, and the rear side member and the fixing side member rotate with a velocity difference set by the velocity difference setting means, and data computing means for computing data related to a toner adhesion amount at each position in a sheet conveyance direction on the sheet is provided, and the velocity difference setting means imparts braking torques corresponding to data at respective positions computed by the data computing means to the fixing side member when the positions in the sheet conveyance direction on the sheet passes through the fixing nip portion.

15. The fixing device according to claim 14, wherein the data computing means computes the data at each position in the sheet conveyance direction on the sheet on the basis of image data corresponding to the toner image on the sheet.

16. The fixing device according to claim 14, wherein the data computing means computes the data at each position in the sheet conveyance direction on the sheet on the basis of a toner image formed on a photoconductor.

17. The fixing device according to claim 14, wherein the data computing means computes the data at each position in the sheet conveyance direction on the sheet on the basis of a toner image formed on an intermediate transfer member.

18. The fixing device according to claim 14, wherein the data computing means computes an integrated value of the toner adhesion amount at each position in a sheet width direction perpendicular to the sheet conveyance direction as the data for each position in the sheet conveyance direction on the sheet.

19. The fixing device according to claim 14, wherein the data computing means computes an average value of the toner adhesion amount at each position in a sheet width direction perpendicular to the sheet conveyance direction as the data for each position in the sheet conveyance direction on the sheet.

20. The fixing device according to claim 14, wherein the data computing means computes a ratio of a position where the toner adhesion amount is greater than a predetermined adhesion amount with respect to positions in a sheet width direction perpendicular to the sheet conveyance direction for each position in the sheet conveyance direction on the sheet.

21. The fixing device according to claim 14, wherein fixing is performed on a first surface of the sheet and then on a second surface of the sheet in the fixing nip portion, the data computing means computes data related to a toner adhesion amount at each position in the sheet conveyance direction on the first and second surfaces of the sheet, and the velocity difference setting means imparts braking torques corresponding to data at respective positions on the first and second surfaces of the sheet computed by the data computing means to the fixing side member when the positions in the sheet conveyance direction on the second surface of the sheet pass through the fixing nip portion.

* * * * *